US007710361B2

(12) United States Patent
Yoon

(10) Patent No.: US 7,710,361 B2
(45) Date of Patent: May 4, 2010

(54) PLASMA DISPLAY APPARATUS AND METHOD OF DRIVING THE SAME

(75) Inventor: Sangjin Yoon, Gyeonggsangbuk-do (KR)

(73) Assignee: LG Electronics Inc., Seoul (KR)

( * ) Notice: Subject to any disclaimer, the term of this patent is extended or adjusted under 35 U.S.C. 154(b) by 777 days.

(21) Appl. No.: 11/537,169

(22) Filed: Sep. 29, 2006

(65) Prior Publication Data

US 2007/0085765 A1 Apr. 19, 2007

(30) Foreign Application Priority Data

Oct. 18, 2005 (KR) ..... 10-2005-0098341
Oct. 21, 2005 (KR) ..... 10-2005-0099776

(51) Int. Cl.
*G09G 3/28* (2006.01)

(52) U.S. Cl. ..... 345/63; 345/60; 315/169.3; 315/169.4

(58) Field of Classification Search ..... 345/60–63; 315/169.3, 169.4
See application file for complete search history.

(56) References Cited

U.S. PATENT DOCUMENTS 6,720,940 B2 * 4/2004 Awamoto et al. ..... 345/60
2001/0054995 A1 * 12/2001 Kasahara et al. ..... 345/63
2002/0097201 A1 * 7/2002 Yamamoto et al. ..... 345/60
2003/0174103 A1 * 9/2003 Choi ..... 345/60
2004/0207571 A1 * 10/2004 Kim ..... 345/60
2005/0062688 A1 * 3/2005 Lee et al. ..... 345/60
2005/0083442 A1 4/2005 Kim
2005/0162345 A1 * 7/2005 Kwon et al. ..... 345/60
2005/0264483 A1 * 12/2005 Jeong ..... 345/63

FOREIGN PATENT DOCUMENTS

| | | |
|---|---|---|
| CN | 1304127 A | 7/2001 |
| EP | 1 265 212 A | 12/2002 |
| KR | 1020040074895 | 8/2004 |
| KR | 1020050040561 | 3/2005 |
| KR | 1020050032355 | 4/2005 |

(Continued)

OTHER PUBLICATIONS

Chinese Office Action dated Jun. 6, 2008, for Application No. 200610140729.4, 16 pages.

(Continued)

*Primary Examiner*—Amare Mengistu
*Assistant Examiner*—Dmitriy Bolotin
(74) *Attorney, Agent, or Firm*—Fish & Richardson P.C.

(57) ABSTRACT

A plasma display apparatus and a method of driving the same are disclosed. In the plasma display apparatus, a relative time ratio of one of a reset period, an address period or a sustain period of an r-th subfield of each of a p-th frame and a q-th frame is substantially equal to each other at a reference time point of the r-th subfield of each of the p-th frame and the q-th frame. The relative time ratio is the ratio of a duration of a portion of one period of a reset period, an address period or a sustain period in one subfield to a total duration of one period. The duration of the portion ranges from a start time point of one period to the reference time point.

16 Claims, 27 Drawing Sheets

FOREIGN PATENT DOCUMENTS

| | | |
|---|---|---|
| KR | 1020050036641 | 4/2005 |
| KR | 1020060014807 | 2/2006 |

OTHER PUBLICATIONS

European Search Report dated Sep. 18, 2009 for Application No. 06020767.7, 6 pages.

Korean Intellectual Property Office, Notice of Decision to Grant a Patent, Application No. 10-2007-0121536, dated Nov. 28, 2007, 3 pages (with English translation).

* cited by examiner

PLASMA DISPLAY APPARATUS AND METHOD OF DRIVING THE SAME

This Nonprovisional application claims priority under 35 U.S.C. §119(a) on Patent Application Nos. 10-2005-0099776 and 10-2005-0098341 filed in Korea on Oct. 18, 2005 and on Oct. 21, 2005, the entire contents of which are hereby incorporated by reference.

BACKGROUND

1. Field

This document relates to a plasma display apparatus and a method of driving the same.

2. Description of the Related Art

A plasma display panel comprises a front panel, a rear panel and barrier ribs formed between the front panel and the rear panel. The barrier ribs form unit discharge cell or discharge cells. Each of the discharge cells is filled with an inert gas containing a main discharge gas such as neon (Ne), helium (He) and a mixture of Ne and He and a small amount of xenon (Xe). When the plasma display panel is discharged by a high frequency voltage, the inert gas generates vacuum ultra-violet rays, which thereby cause phosphors formed between the barrier ribs to emit light, thus displaying an image. Since the plasma display panel can be manufactured to be thin and light, it has attracted attention as a next generation display device.

The plasma display panel is driven by dividing a frame into several subfields having a different number of emission times. Each of the subfields is subdivided into a reset period for uniformly generating the discharge, an address period for selecting cells to be discharged and a sustain period for representing gray scale in accordance with the number of discharges. For example, if an image with 256-level gray scale is to be displayed, a frame period (for example, 16.67 ms) corresponding to 1/60 sec is divided into eight subfields SF1 to SF8.

The duration of the reset period in a subfield is equal to the duration of the reset periods in the remaining subfields. The duration of the address period in a subfield is equal to the duration of the address periods in the remaining subfields. The sustain period increases in a ratio of $2^n$ (where, n=0, 1, 2, 3, 4, 5, 6, 7) in each of the subfields. Since the sustain period varies from one subfield to the next subfield, a specific gray level of the image is achieved.

SUMMARY

In one aspect, a plasma display apparatus comprises a plasma display panel comprising an electrode, an electrode driver for supplying a driving signal to the electrode, and a driving signal controller for controlling the electrode driver so that a relative time ratio of one of a reset period, an address period or a sustain period of an r-th subfield of a p-th frame at a reference time point of the r-th subfield of the p-th frame is substantially equal to a relative time ratio of one of a reset period, an address period or a sustain period of an r-th subfield of a q-th frame at a reference time point of the r-th subfield of the q-th frame, wherein the relative time ratio is the ratio of a duration of a portion of one period of a reset period, an address period or a sustain period in one subfield to a total duration of one period, and the duration of the portion ranges from a start time point of one period of the reset period, the address period or the sustain period in one subfield to the reference time point.

In another aspect, a method of driving a plasma display apparatus comprising an electrode comprises supplying a first driving signal during a reset period, an address period and a sustain period of an r-th subfield of a p-th frame, and supplying a second driving signal during a reset period, an address period and a sustain period of an r-th subfield of a q-th frame, wherein a relative time ratio of one of the reset period, the address period or the sustain period of the r-th subfield of the p-th frame at a reference time point of the r-th subfield of the p-th frame is substantially equal to a relative time ratio of one of the reset period, the address period or the sustain period of an r-th subfield of a q-th frame at a reference time point of the r-th subfield of the q-th frame, the relative time ratio is defined as the ratio of a duration of a portion of one period of a reset period, an address period or a sustain period in one subfield to a total duration of one period, and the duration of the portion ranges from a start time point of one period of the reset period, the address period or the sustain period in one subfield to the reference time point.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF PREFERRED EMBODIMENTS

Figure 1:
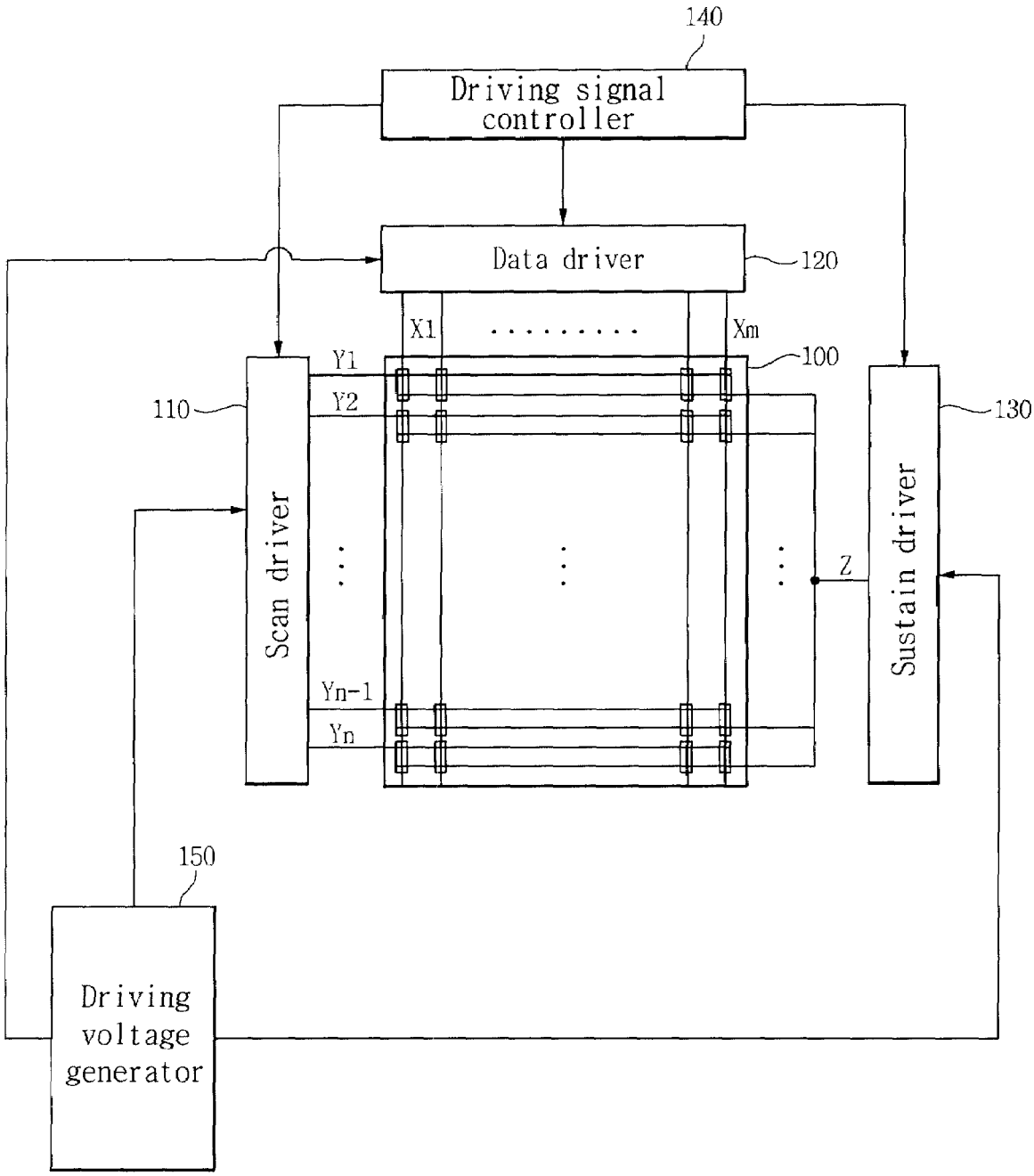
FIG. 1 illustrates a plasma display apparatus.

Embodiments of the present invention will be described in a more detailed manner with reference to the drawings.

A plasma display apparatus comprises a plasma display panel comprising an electrode, an electrode driver for supplying a driving signal to the electrode, and a driving signal controller for controlling the electrode driver so that a relative time ratio of one of a reset period, an address period or a sustain period of an r-th subfield of a p-th frame at a reference time point of the r-th subfield of the p-th frame is substantially equal to a relative time ratio of one of a reset period, an address period or a sustain period of an r-th subfield of a q-th frame at a reference time point of the r-th subfield of the q-th frame, wherein the relative time ratio is the ratio of a duration of a portion of one period of a reset period, an address period or a sustain period in one subfield to a total duration of one period, and the duration of the portion ranges from a start time point of one period of the reset period, the address period or the sustain period in one subfield to the reference time point.

An average picture level (APL) during the p-th frame and an APL during the q-th frame may be different from each other.

The relative time ratio may be substantially equal to 0.

The relative time ratio may be substantially equal to 1.

A duration of the r-th subfield of the p-th frame may be different from a duration of the r-th subfield of the q-th frame.

The highest voltage of a reset signal supplied during the reset period of the r-th subfield of the p-th frame may be different from the highest voltage of a reset signal supplied during the reset period of the r-th subfield of the q-th frame.

The width of a scan signal supplied during the address period of the r-th subfield of the p-th frame may be different from the width of a scan signal supplied during the address period of the r-th subfield of the q-th frame.

A reference time point being a light emission center in the sustain period of the r-th subfield of the p-th frame may be substantially equal to a reference time point being a light emission center in the sustain period of the r-th subfield of the q-th frame, wherein the light emission center is obtained by the following equation, $$\text{Light emission center} = \frac{\sum_{i=1}^{N} \text{SUS_DISi}}{N}$$

where N indicates a total number of sustain signals supplied during a sustain period of one subfield, and SUS_DISi indicates a duration of time ranging from a start time point of the sustain period of one subfield to a supply time point of an i-th sustain signal during the sustain period.

A cycle of the sustain signal supplied during the sustain period of the r-th subfield of the p-th frame or a cycle of the sustain signal supplied during the sustain period of the r-th subfield of the q-th frame may be not uniform.

A method of driving a plasma display apparatus comprising an electrode comprises supplying a first driving signal during a reset period, an address period and a sustain period of an r-th subfield of a p-th frame, and supplying a second driving signal during a reset period, an address period and a sustain period of an r-th subfield of a q-th frame, wherein a relative time ratio of one of the reset period, the address period or the sustain period of the r-th subfield of the p-th frame at a reference time point of the r-th subfield of the p-th frame is substantially equal to a relative time ratio of one of the reset period, the address period or the sustain period of an r-th subfield of a q-th frame at a reference time point of the r-th subfield of the q-th frame, the relative time ratio is defined as the ratio of a duration of a portion of one period of a reset period, an address period or a sustain period in one subfield to a total duration of one period, and the duration of the portion ranges from a start time point of one period of the reset period, the address period or the sustain period in one subfield to the reference time point.

Hereinafter, exemplary embodiments of the present invention will be described in detail with reference to the attached drawings.

FIG. 1 illustrates a plasma display apparatus. As illustrated in FIG. 1, the plasma display apparatus comprises a plasma display panel 100, a scan driver 110, a data driver 120, a sustain driver 130, a driving signal controller 140 and a driving voltage generator 150.

The plasma display panel 100 comprises address electrodes X1 to Xm, scan electrodes Y1 to Yn and sustain electrodes Z. The address electrodes X1 to Xm, the scan electrodes Y1 to Yn and the sustain electrodes Z each receive a driving signal during a reset period, an address period and a sustain period, and thus displaying an image in accordance with a combination of subfields.

The scan driver 110 supplies a reset signal for uniformalizing wall charges within a discharge cell of the plasma display panel 100 during the reset period, a scan signal for selecting a discharge cell to be discharged during the address period, and a sustain signal for generating a sustain discharge in the selected discharge cell during the sustain period, to the scan electrodes Y1 to Yn.

The data driver 120 supplies a data signal for selecting a discharge cell to be discharged to the address electrodes X1 to Xm during the address period, when the scan driver 110 supplies the scan signal to the scan electrodes Y1 to Yn.

The sustain driver 130 supplies a sustain signal for generating a sustain discharge to the sustain electrodes Z during the sustain period.

The driving signal controller 140 controls the scan driver 110, the data driver 120 and the sustain driver 130 so that a relative time ratio of one of a reset period, an address period or a sustain period of an r-th subfield of a p-th frame at a reference time point after a predetermined period of time from a start time point of the p-th frame is equal to a relative time ratio of one of a reset period, an address period or a sustain period of an r-th subfield of a q-th frame at a reference time point after a predetermined period of time from a start time point of the q-th frame. This results in fixing locations of subfields of each frame. Where p and q are different natural numbers, and r is a natural number. The relative time ratio is the ratio of a duration of a portion of one period of a reset period, an address period or a sustain period in one subfield to a total duration of one period. The duration of the portion ranges from a start time point of one period of the reset period, the address period or the sustain period in one subfield to the reference time point. In other words, the relative time ratios at the reference time point after the predetermined period of time from the start time point of each of the p-th frame and the q-th frame are equal to each other. The relative time ratios are calculated from one of the reset periods, the address periods or the sustain periods of the r-th subfields of the p-th frame and the q-th frame. Operation of the driving signal controller 140 will be described in detail later with reference to the attached drawings.

The driving voltage generator 150 supplies a driving voltage for forming the driving signal supplied by each of the scan driver 110, the data driver 120 and the sustain driver 130

Figure 2:
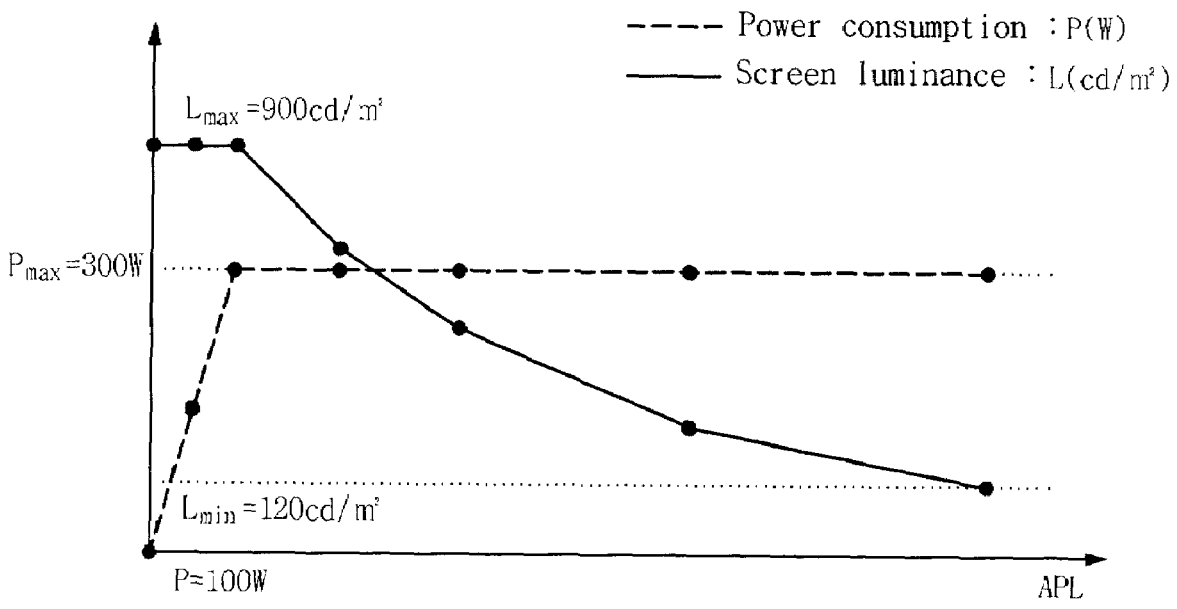
FIG. 2 illustrates a load effect of the plasma display apparatus.

FIG. 2 illustrates a load effect of the plasma display apparatus. As illustrated in FIG. 2, as an average picture level (APL) increases, power consumption (P) increases to 300 W and then is maintained at a constant level. In other words, the plasma display apparatus is maintained at a maximum power consumption level (Pmax), irrespective of the APL.

Since the plasma display apparatus is maintained at the maximum power consumption level (Pmax), a screen luminance (L) decreases as the APL increases. A reduction in the screen luminance (L) means a reduction in a duration of a sustain period. In other words, when the APL is at the maximum, a duration of a sustain period is at the minimum, and when the APL is at the minimum, a duration of a sustain period is at the maximum.

Figure 3A:
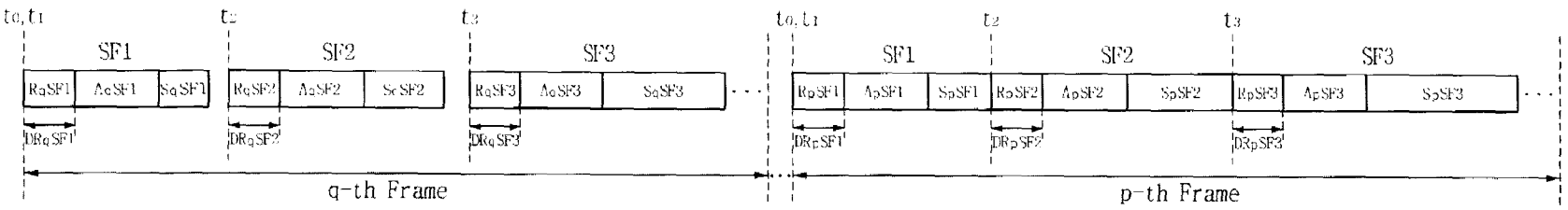
FIGS. 3*a* and 3*b* illustrate an example of an operation of a driving signal controller of the plasma display apparatus.
Figure 3B:
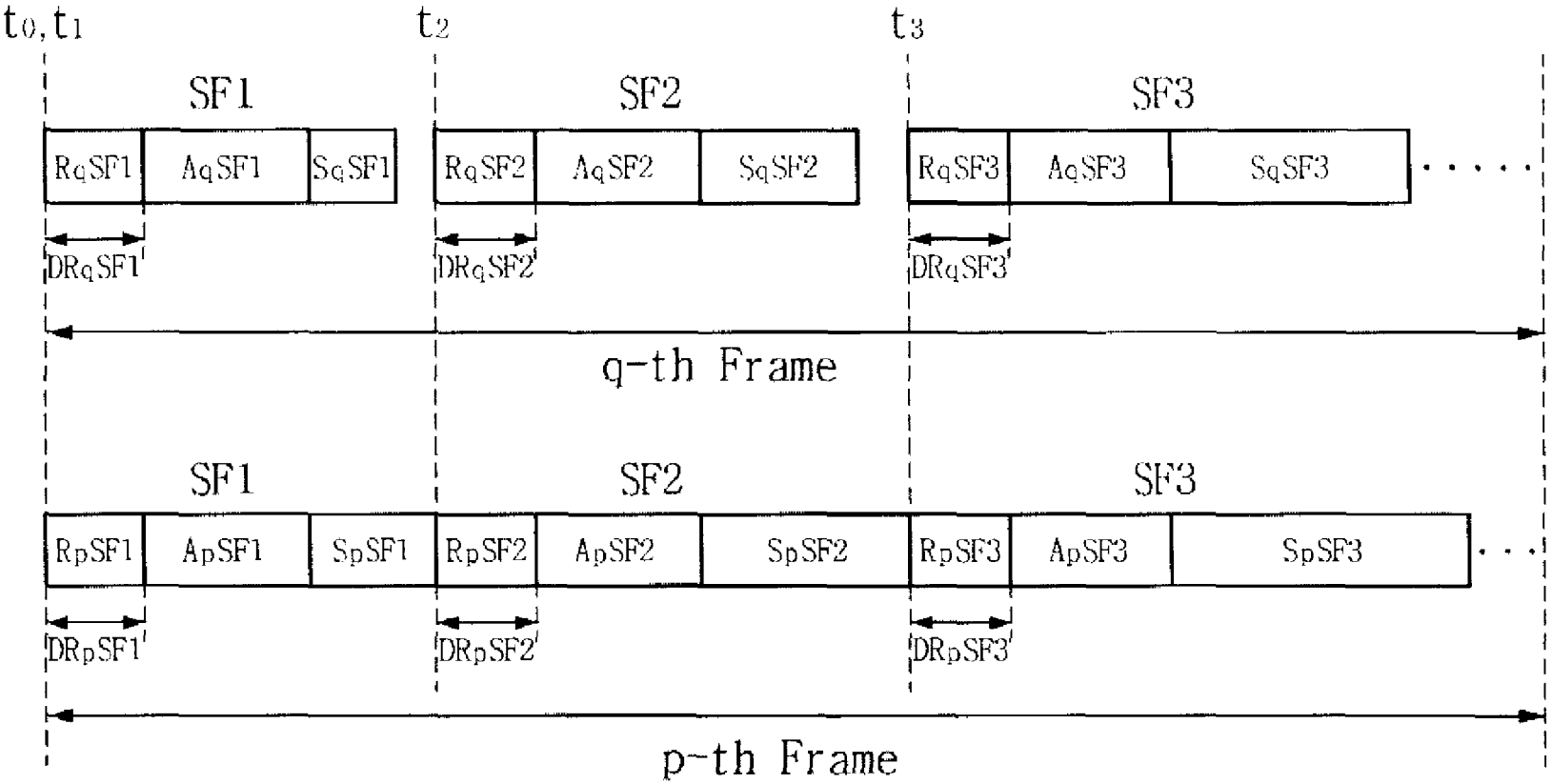

FIGS. 3*a* and 3*b* illustrate an example of an operation of a driving signal controller of the plasma display apparatus. As illustrated in FIGS. 3*a* and 3*b*, an APL of the p-th frame is less than an APL of the q-th frame. For example, the APL of the p-th frame may be at the minimum, and the APL of the q-th frame may be at the maximum. Accordingly, a duration of a sustain period of the p-th frame may be at the maximum, and a duration of a sustain period of the q-th frame may be at the minimum.

As illustrated in FIG. 3*a*, the driving signal controller 140 controls a relative time ratio of a reset period $R_p$SF1 of a first subfield SF1 of the p-th frame at a reference time point $t_1$ after a predetermined period of time from a start time point $t_0$ of the p-th frame to be substantially equal to a relative time ratio of a reset period $R_q$SF1 of a first subfield SF1 of the q-th frame at a reference time point $t_1$ after a predetermined period of time from a start time point $t_0$ of the q-th frame.

For example, when the predetermined period of time is 0, the start time point $t_0$ and the reference time point $t_1$ are equal to each other. The driving signal controller 140 controls a location of the first subfield SF1 of each of the p-th frame and the q-th frame so that the relative time ratios of the reset periods $R_p$SF1 and $R_q$SF1 of the first subfields SF1 of the p-th frame and the q-th frame are 0 at the reference time point $t_1$ ($=t_0$) of each of the p-th frame and the q-th frame. More specifically, the location of the first subfield SF1 of each of the p-th frame and the q-th frame is controlled so that the ratio of a duration (=0) of a portion of the reset period $R_p$SF1 to a total duration $DR_p$SF1 of the reset period $R_p$SF1 of the first subfield SF1 of the p-th frame and the ratio of a duration (=0) of a portion of the reset period $R_q$SF1 to a total duration $DR_q$SF1 of the reset period $R_q$SF1 of the first subfield SF1 of the q-th frame are 0 at the reference time point $t_1$.

The driving signal controller 140 controls a relative time ratio of a reset period $R_p$SF2 of a second subfield SF2 of the p-th frame at a reference time point $t_2$ after a predetermined period of time from the start time point $t_0$ of the p-th frame to be substantially equal to a relative time ratio of a reset period $R_q$SF2 of a second subfield SF2 of the q-th frame at a reference time point $t_2$ after a predetermined period of time from the start time point $t_0$ of the q-th frame.

In other words, the driving signal controller 140 controls a location of the second subfield SF2 of each of the p-th frame and the q-th frame so that the relative time ratios of the reset periods $R_p$SF2 and $R_q$SF2 of the second subfields SF2 of the p-th frame and the q-th frame are 0 at the reference time point $t_2$ of each of the p-th frame and the q-th frame. More specifically, the location of the second subfield SF2 of each of the p-th frame and the q-th frame is controlled so that the ratio of a duration (=0) of a portion of the reset period $R_p$SF2 to a total duration $DR_p$SF2 of the reset period $R_p$SF2 of the second subfield SF2 of the p-th frame at the reference time point $t_2$ is substantially equal to the ratio of a duration (=0) of a portion of the reset period $R_q$SF2 to a total duration $DR_q$SF2 of the reset period $R_q$SF2 of the second subfield SF2 of the q-th frame at the reference time point $t_2$.

As described above, the driving signal controller 140 controls a location of an r-th subfield of each of the p-th frame and the q-th frame so that a relative time ratio of a reset period of the r-th subfield of the p-th frame at a reference time point of the r-th subfield of the p-th frame is substantially equal to a relative time ratio of a reset period of the r-th subfield of the q-th frame at a reference time point of the r-th subfield of the q-th frame. Accordingly, as illustrated in FIG. 3*b*, reset periods of subfields constituting each frame start at the same time point such that locations of the subfields of each frame are fixed. As a result, the driving signal controller 140 easily and rapidly calculates the locations of the subfields of each frame, thereby simplifying the configuration of the driving signal controller 140.

Figure 4A:
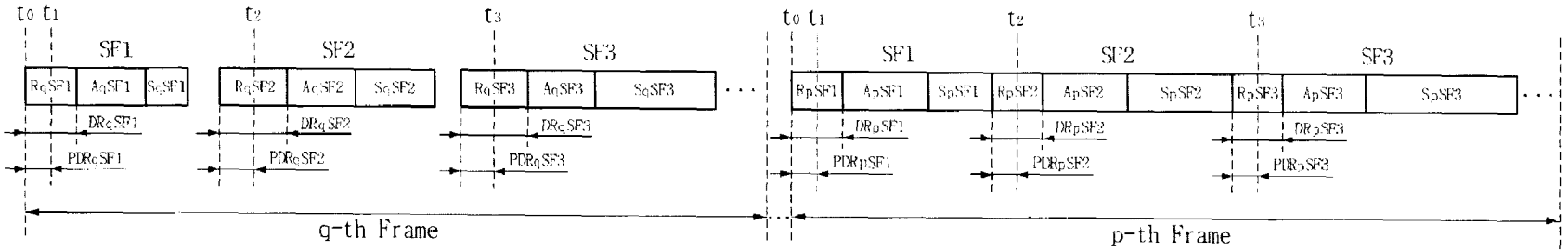
FIGS. 4*a* and 4*b* illustrate another example of an operation of the driving signal controller of the plasma display apparatus.
Figure 4B:
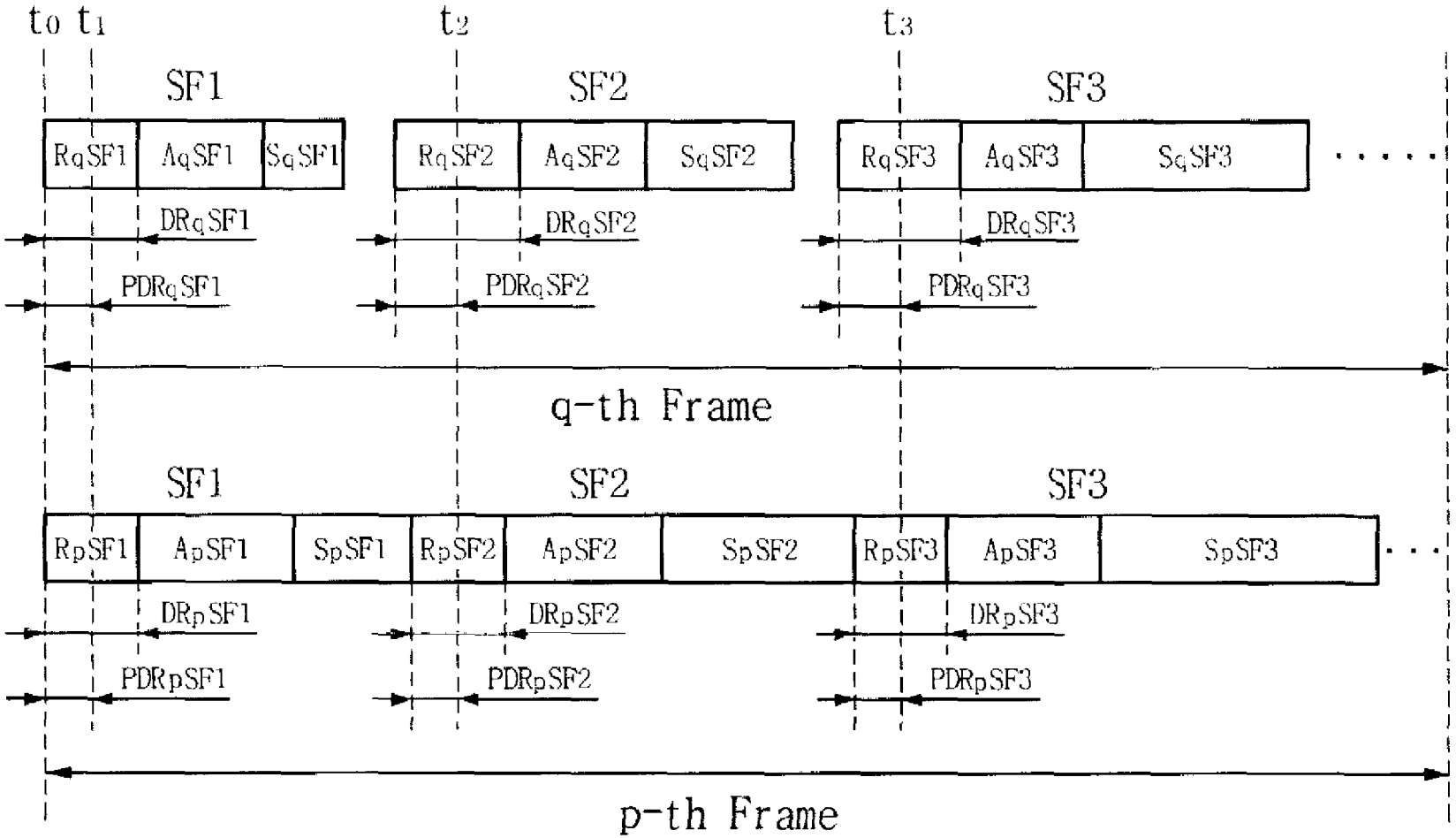

FIGS. 4*a* and 4*b* illustrate another example of an operation of the driving signal controller of the plasma display apparatus. As illustrated in FIGS. 4*a* and 4*b*, an APL of the p-th frame is less than an APL of the q-th frame. For example, the APL of the p-th frame may be at the minimum, and the APL of the q-th frame may be at the maximum. Accordingly, a duration of a sustain period of the p-th frame may be at the maximum, and a duration of a sustain period of the q-th frame may be at the minimum.

As illustrated in FIG. 4*a*, the driving signal controller 140 controls a relative time ratio of a reset period $R_p$SF1 of a first subfield SF1 of the p-th frame at a reference time point $t_1$ after a predetermined period of time from a start time point $t_0$ of the p-th frame to be substantially equal to a relative time ratio of a reset period $R_q$SF1 of a first subfield SF1 of the q-th frame at a reference time point $t_1$ after a predetermined period of time from a start time point $t_0$ of the q-th frame.

The driving signal controller 140 controls a location of the first subfield SF1 of each of the p-th frame and the q-th frame so that the relative time ratios of the reset periods $R_p$SF1 and $R_q$SF1 of the first subfields SF1 of the p-th frame and the q-th frame are substantially equal to each other at the reference time point $t_1$ of each of the p-th frame and the q-th frame. More specifically, the location of the first subfield SF1 of each of the p-th frame and the q-th frame is controlled so that the ratio of a duration $PDR_p$SF1 of a portion of the reset period $R_p$SF1 to a total duration $DR_p$SF1 of the reset period $R_p$SF1 of the first subfield SF1 of the p-th frame at the reference time point $t_1$ of the first subfield SF1 of the p-th frame is substantially equal to the ratio of a duration $PDR_q$SF1 of a portion of the reset period $R_q$SF1 to a total duration $DR_q$SF1 of the reset period $R_q$SF1 of the first subfield SF1 of the q-th frame at the reference time point $t_1$ of the first subfield SF1 of the q-th frame.

The driving signal controller 140 controls a relative time ratio of a reset period $R_p$SF2 of a second subfield SF2 of the p-th frame at a reference time point $t_2$ after a predetermined period of time from the start time point $t_0$ of the p-th frame to be substantially equal to a relative time ratio of a reset period $R_q$SF2 of a second subfield SF2 of the q-th frame at a reference time point $t_2$ after a predetermined period of time from the start time point $t_0$ of the q-th frame.

In other words, the driving signal controller 140 controls a location of the second subfield SF2 of each of the p-th frame and the q-th frame so that the relative time ratios of the reset periods $R_p$SF2 and $R_q$SF2 of the second subfields SF2 of the p-th frame and the q-th frame are substantially equal to each other at the reference time point $t_2$ of each of the p-th frame and the q-th frame. More specifically, the location of the second subfield SF2 of each of the p-th frame and the q-th frame is controlled so that the ratio of a duration $PDR_p$SF2 of a portion of the reset period $R_p$SF2 to a total duration $DR_p$SF2 of the reset period $R_p$SF2 of the second subfield SF2 of the p-th frame at the reference time point $t_2$ of the second subfield SF2 of the p-th frame is substantially equal to the ratio of a duration $PDR_q$SF2 of a portion of the reset period $R_q$SF2 to a total duration $DR_qSF2$ of the reset period $R_qSF2$ of the second subfield SF2 of the q-th frame at the reference time point $t_2$ of the second subfield SF2 of the q-th frame.

The driving signal controller 140 controls a location of the second subfield SF2 of each of the p-th frame and the q-th frame so that each of relative time ratios of reset periods of the remaining subfields SF3, SF4, . . . of the p-th frame is substantially equal to each of relative time ratios of reset periods of the remaining subfields SF3, SF4, . . . of the q-th frame at reference time points $t_3$, $t_4$, . . . of each of the p-th frame and the q-th frame.

As described above, the driving signal controller 140 controls a location of an r-th subfield of each of the p-th frame and the q-th frame so that a relative time ratio of a reset period of the r-th subfield of the p-th frame at a reference time point of the r-th subfield of the p-th frame is substantially equal to a relative time ratio of a reset period of the r-th subfield of the q-th frame at a reference time point of the r-th subfield of the q-th frame. Accordingly, as illustrated in FIG. 4*b*, reset periods of subfields constituting each frame start at the same time point, for example, $t_1$, $t_2$, $t_3$, . . . such that locations of the subfields of each frame are fixed. As a result, the driving signal controller 140 easily and rapidly calculates the locations of the subfields of each frame, thereby simplifying the configuration of the driving signal controller 140.

As illustrated in FIGS. 3*a* and 3*b*, when the total durations of the reset periods of the subfields are equal to one another, it is possible to fix the locations of the subfields. As illustrated in FIGS. 4*a* and 4*b*, when the total durations of the reset periods of the subfields are different from one another, it is possible to fix the locations of the subfields.

Figure 5A:
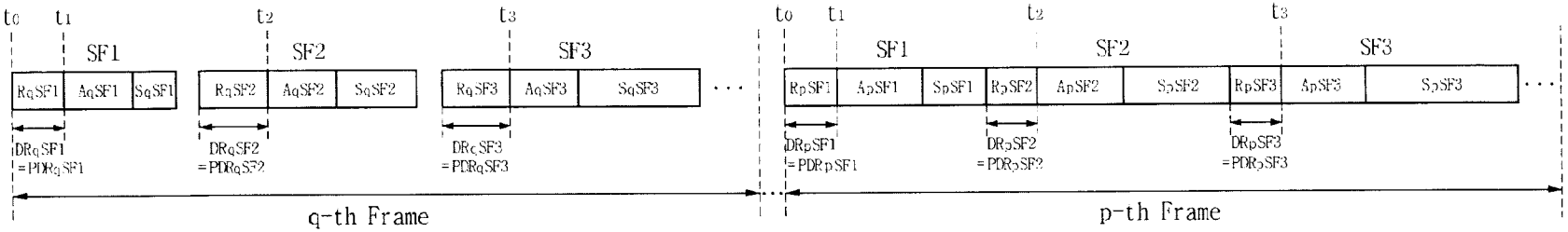
FIGS. 5*a* and 5*b* illustrate another example of an operation of the driving signal controller of the plasma display apparatus.
Figure 5B:
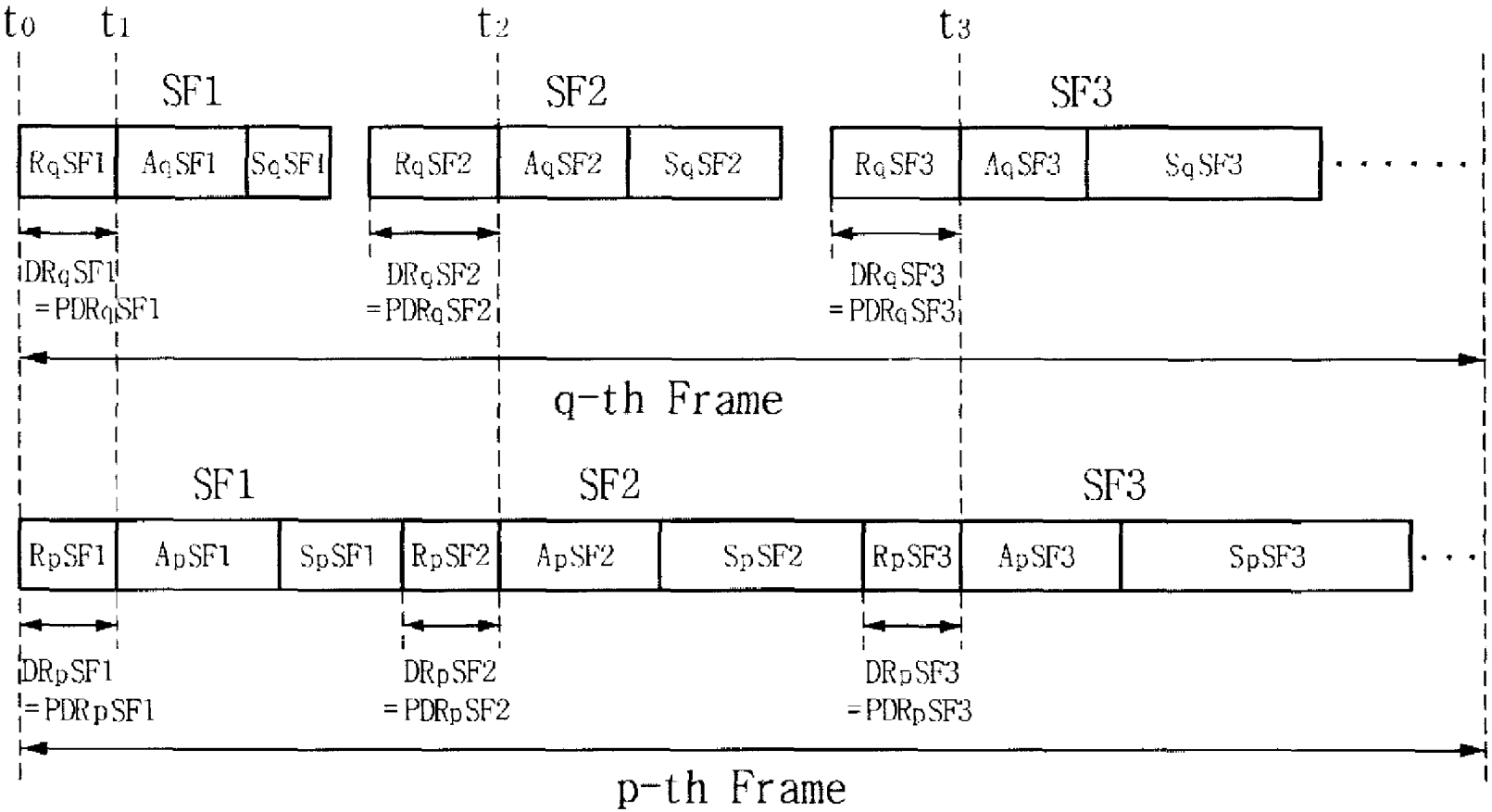

FIGS. 5*a* and 5*b* illustrate another example of an operation of the driving signal controller of the plasma display apparatus. As illustrated in FIGS. 5*a* and 5*b*, an APL of the p-th frame is less than an APL of the q-th frame. For example, the APL of the p-th frame may be at the minimum, and the APL of the q-th frame may be at the maximum. Accordingly, a duration of a sustain period of the p-th frame may be at the maximum, and a duration of a sustain period of the q-th frame may be at the minimum.

As illustrated in FIG. 5*a*, the driving signal controller 140 controls a location of a first subfield SF1 of each of the p-th frame and the q-th frame so that relative time ratios of reset periods $R_pSF1$ and $R_qSF1$ of the first subfields SF1 of the p-th frame and the q-th frame are substantially equal to each other at a reference time point $t_1$ after a predetermined period of time from a start time point $t_0$ of each of the p-th frame and the q-th frame. More specifically, the driving signal controller 140 controls the location of the first subfield SF1 of each of the p-th frame and the q-th frame so that the ratio (=1) of a duration $PDR_pSF1$ of a portion of the reset period $R_pSF1$ to a total duration $DR_pSF1$ of the reset period $R_pSF1$ of the first subfield SF1 of the p-th frame at the reference time point $t_1$ of the first subfield SF1 of the p-th frame is substantially equal to the ratio (=1) of a duration $PDR_qSF1$ of a portion of the reset period $R_qSF1$ to a total duration $DR_qSF1$ of the reset period $R_qSF1$ of the first subfield SF1 of the q-th frame at the reference time point $t_1$ of the first subfield SF1 of the q-th frame.

The driving signal controller 140 controls a location of a second subfield SF2 of each of the p-th frame and the q-th frame so that the ratio (=1) of a duration $PDR_pSF2$ of a portion of a reset period $R_pSF2$ to a total duration $DR_pSF2$ of the reset period $R_pSF2$ of the second subfield SF2 of the p-th frame at a reference time point $t_2$ of the second subfield SF2 of the p-th frame is substantially equal to the ratio (=1) of a duration $PDR_qSF2$ of a portion of a reset period $R_qSF2$ to a total duration $DR_qSF2$ of the reset period $R_qSF2$ of the second subfield SF2 of the q-th frame at a reference time point $t_2$ of the second subfield SF2 of the q-th frame.

As described above, the driving signal controller 140 controls a location of an r-th subfield of each of the p-th frame and the q-th frame so that a relative time ratio of a reset period of the r-th subfield of the p-th frame at a reference time point of the r-th subfield of the p-th frame is substantially equal to a relative time ratio of a reset period of the r-th subfield of the q-th frame at a reference time point of the r-th subfield of the q-th frame. Accordingly, as illustrated in FIG. 5*b*, reset periods of subfields constituting each frame start at the same time point, for example, $t_1$, $t_2$, $t_3$, . . . such that locations of the subfields of each frame are fixed. As a result, the driving signal controller 140 easily and rapidly calculates the locations of the subfields of each frame, thereby simplifying the configuration of the driving signal controller 140.

Figure 6A:
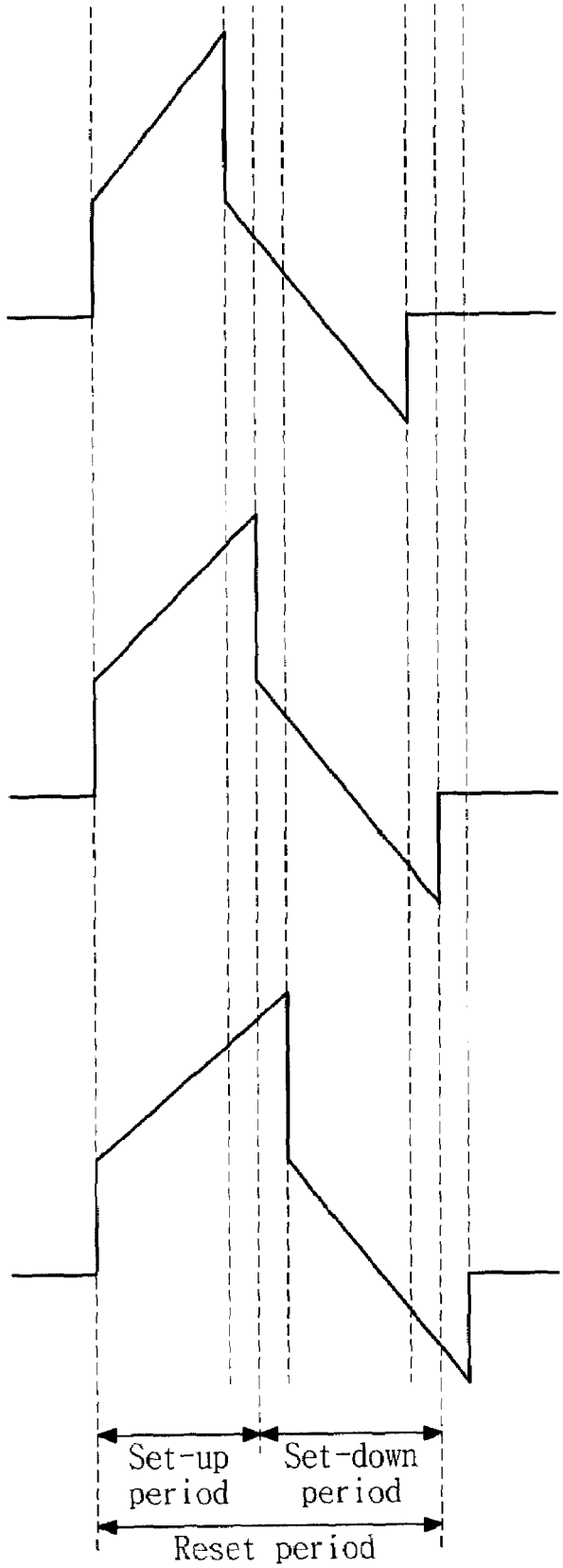
FIGS. 6*a* through 6*d* illustrate a change in a reset period.
Figure 6B:
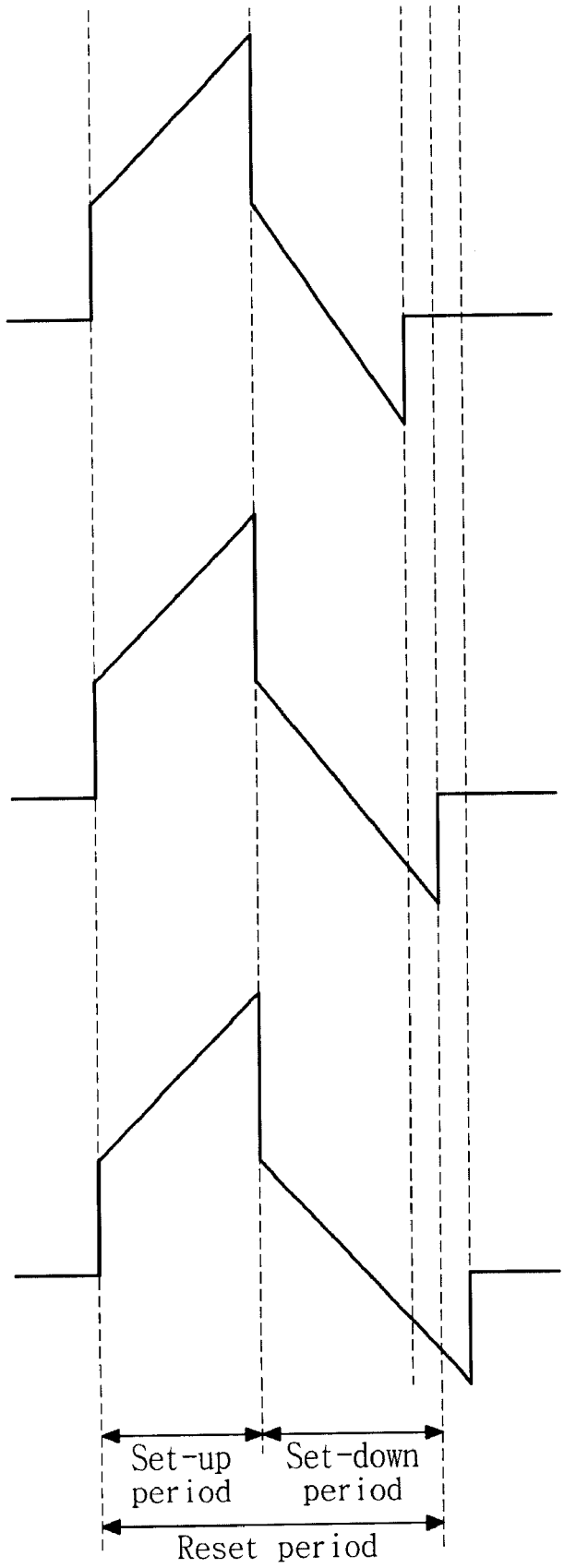
Figure 6C:
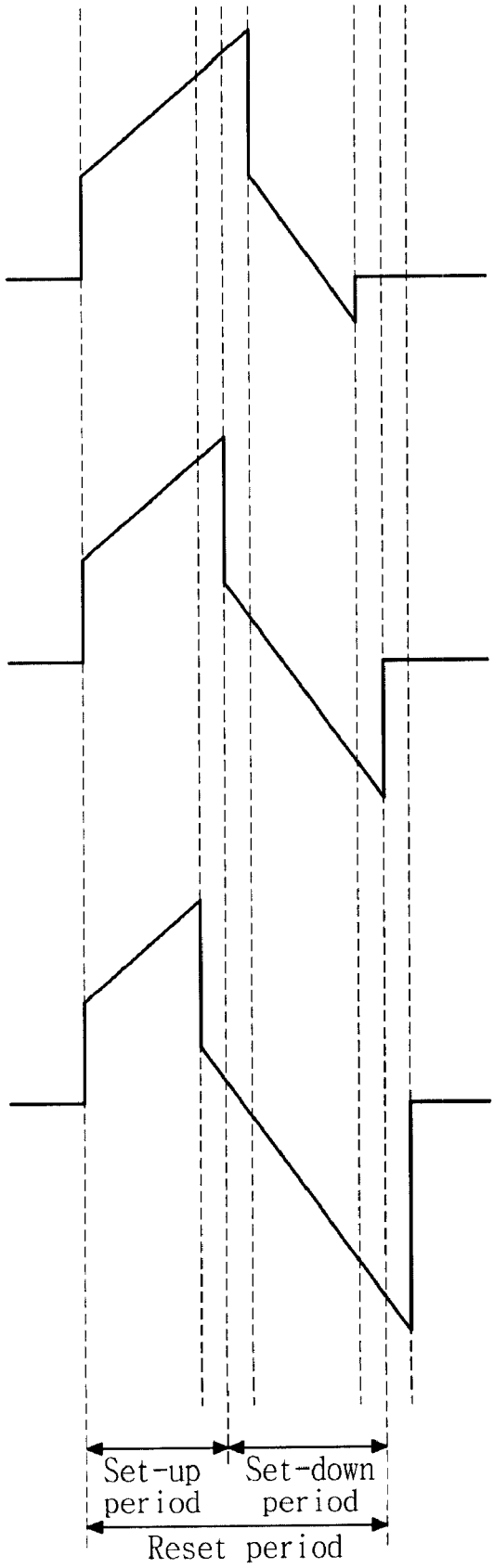
Figure 6D:
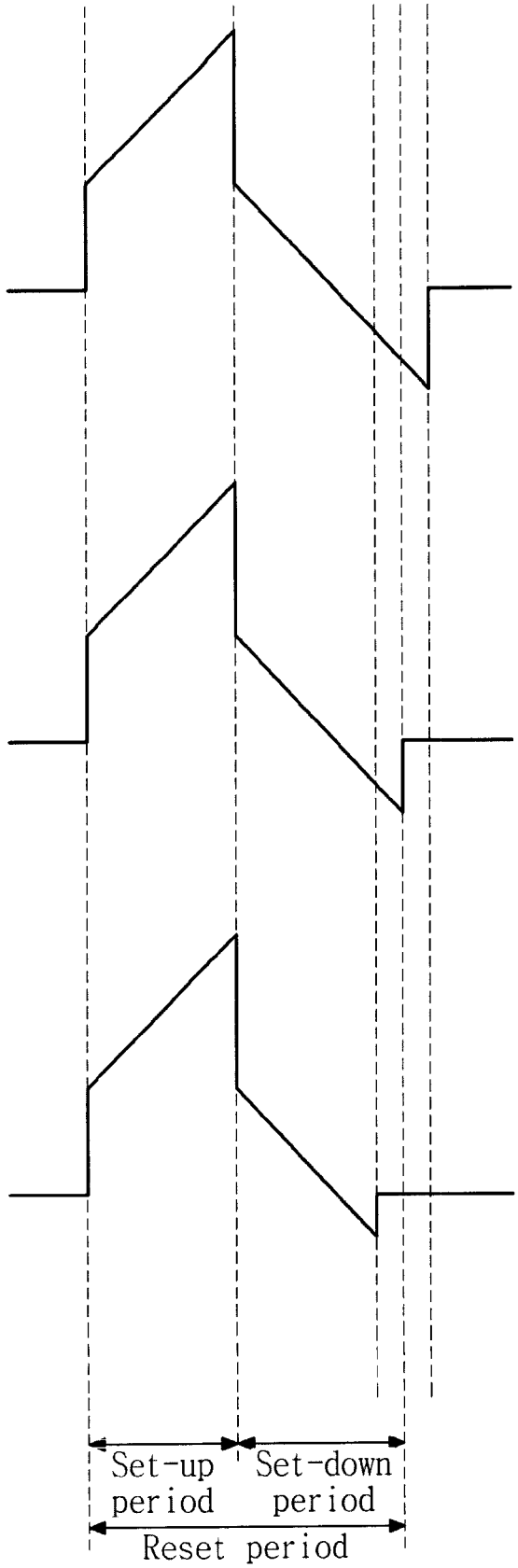

FIGS. 6*a* and 6*d* illustrate a change in a reset period. As illustrated in FIGS. 6*a* and 6*d*, a reset period is divided into a setup period and a set-down period. As illustrated in FIG. 6*a*, a slope of a reset signal supplied during the setup period of the reset period varies. When the slope of the reset signal supplied during the setup period increases, a duration of the reset period shortens. When the slope of the reset signal supplied during the setup period decreases, a duration of the reset period lengthens. As illustrated in FIG. 6*b*, a slope of a reset signal supplied during the set-down period of the reset period varies. When the slope of the reset signal supplied during the set-down period increases, a duration of the reset period shortens. When the slope of the reset signal supplied during the set-down period decreases, a duration of the reset period lengthens.

As illustrated in FIG. 6*c*, the highest voltage of a reset signal supplied during the setup period of the reset period varies. When the highest voltage of the reset signal supplied during the setup period increases, a duration of the reset period lengthens. When the highest voltage of the reset signal supplied during the setup period decreases, a duration of the reset period shortens. As illustrated in FIG. 6*d*, the lowest voltage of a reset signal supplied during the set-down period of the reset period varies. When the lowest voltage of the reset signal supplied during the set-down period decreases, a duration of the reset period lengthens. When the lowest voltage of the reset signal supplied during the set-down period increases, a duration of the reset period shortens.

Figure 7A:
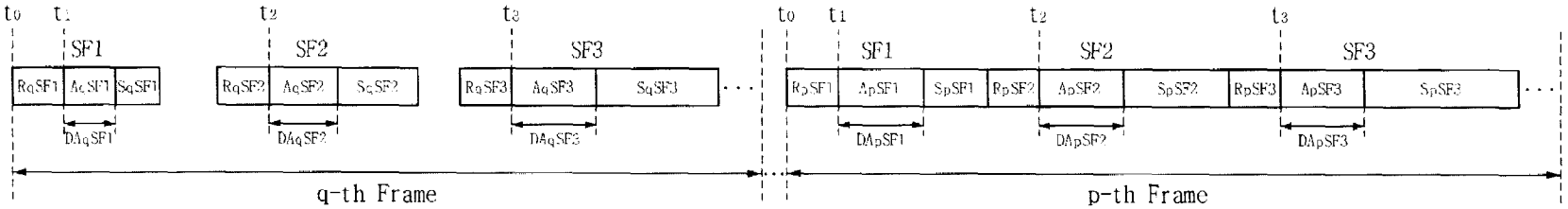
FIGS. 7*a* and 7*b* illustrate another example of an operation of the driving signal controller of the plasma display apparatus.
Figure 7B:
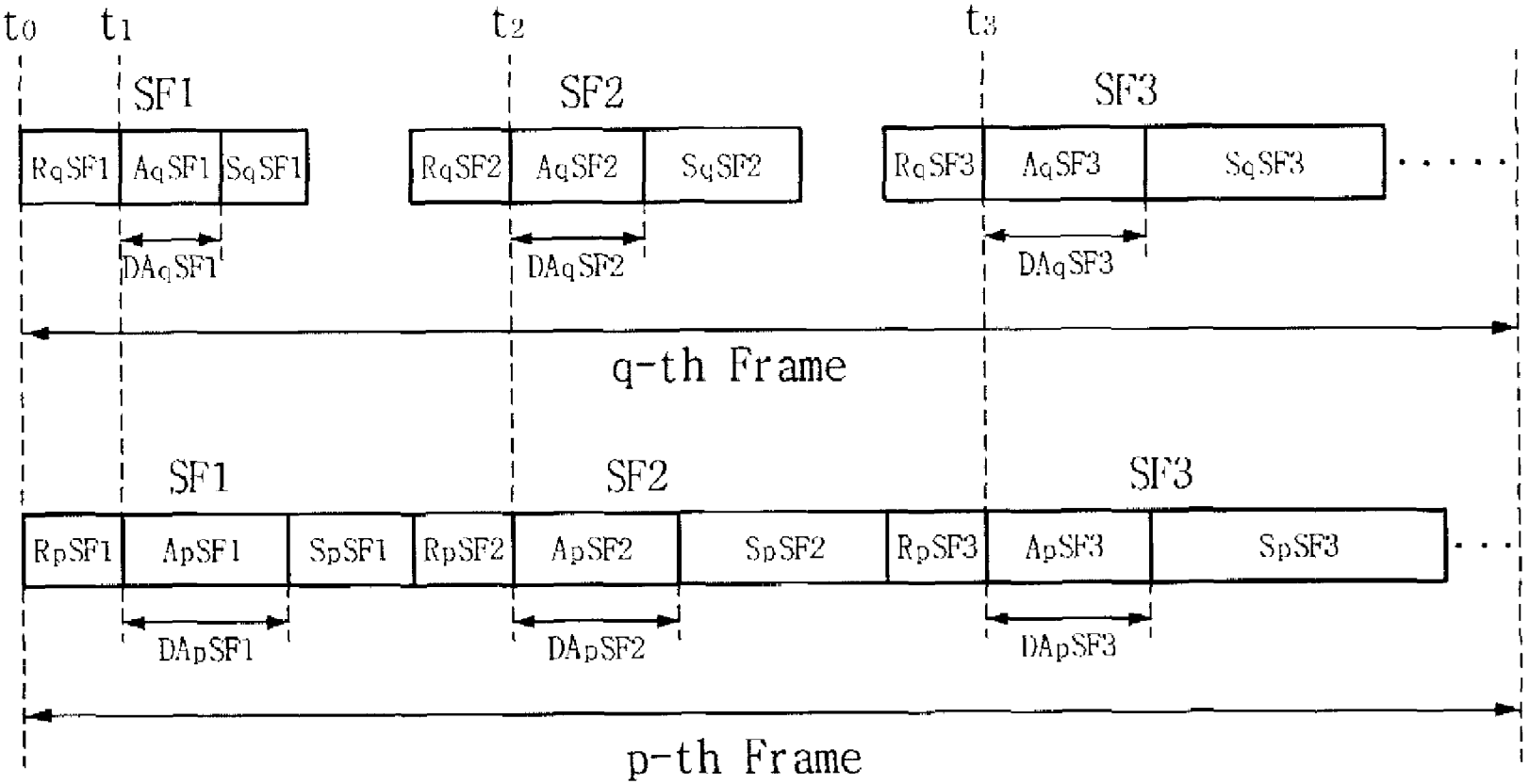

FIGS. 7*a* and 7*b* illustrate another example of an operation of the driving signal controller of the plasma display apparatus. As illustrated in FIGS. 7*a* and 7*b*, an APL of the p-th frame is less than an APL of the q-th frame.

As illustrated in FIG. 7*a*, the driving signal controller 140 controls a location of the first subfield SF1 of each of the p-th frame and the q-th frame so that the ratio of a duration (=0) of a portion of an address period $A_pSF1$ to a total duration $DA_pSF1$ of the address period $A_pSF1$ of the first subfield SF1 of the p-th frame and the ratio of a duration (=0) of a portion of an address period $A_qSF1$ to a total duration $DA_qSF1$ of the address period $A_qSF1$ of the first subfield SF1 of the q-th frame are 0 at a reference time point $t_1$ after a predetermined period of time from a start time point $t_0$ of each of the p-th frame and the q-th frame.

The driving signal controller 140 controls a location of the second subfield SF2 of each of the p-th frame and the q-th frame so that the ratio of a duration (=0) of a portion of an address period $A_pSF2$ to a total duration $DA_pSF2$ of the address period $A_pSF2$ of the second subfield SF2 of the p-th frame and the ratio of a duration (=0) of a portion of an address period $A_qSF2$ to a total duration $DA_qSF2$ of the address period $A_qSF2$ of the second subfield SF2 of the q-th frame are 0 at a reference time point $t_2$ after a predetermined period of time from the start time point $t_0$ of each of the p-th frame and the q-th frame.

As described above, the driving signal controller 140 controls a location of an r-th subfield of each of the p-th frame and the q-th frame so that a relative time ratio of an address period of the r-th subfield of the p-th frame at a reference time point of the r-th subfield of the p-th frame is substantially equal to a relative time ratio of an address period of the r-th subfield of the q-th frame at a reference time point of the r-th subfield of the q-th frame. Accordingly, as illustrated in FIG. 7*b*, address periods of subfields constituting each frame start at the same time point such that locations of the subfields of each frame are fixed. As a result, the driving signal controller 140 easily and rapidly calculates the locations of the subfields of each frame, thereby simplifying the configuration of the driving signal controller 140.

Figure 8A:
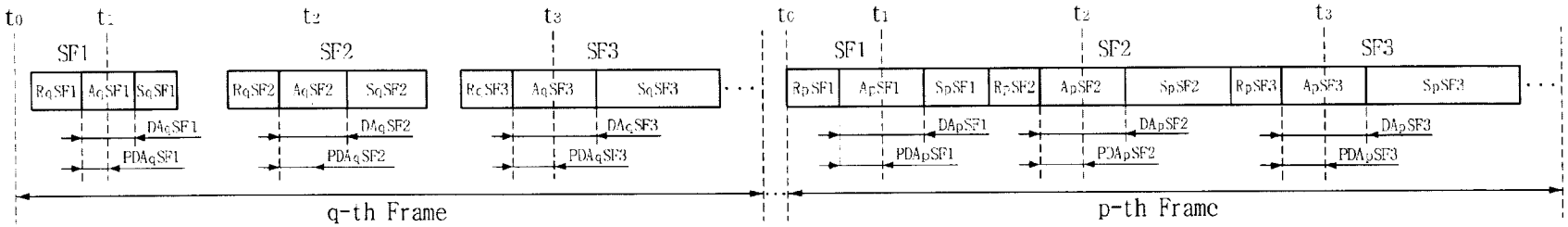
FIGS. 8*a* and 8*b* illustrate another example of an operation of the driving signal controller of the plasma display apparatus.
Figure 8B:
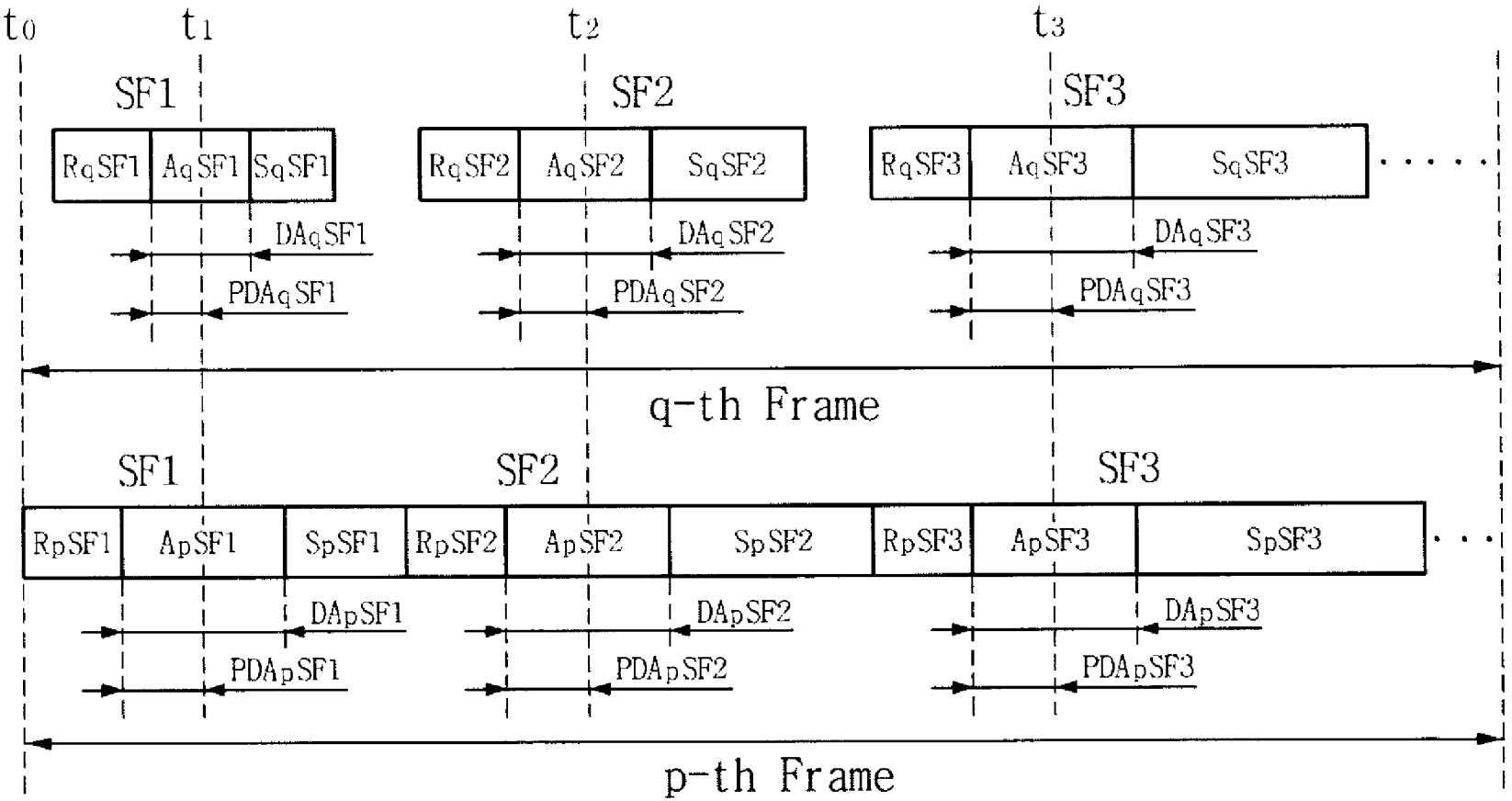

FIGS. 8*a* and 8*b* illustrate another example of an operation of the driving signal controller of the plasma display apparatus. As illustrated in FIGS. 8*a* and 8*b*, an APL of the p-th frame is less than an APL of the q-th frame.

As illustrated in FIG. 8*a*, the driving signal controller 140 controls a location of the first subfield SF1 of each of the p-th frame and the q-th frame so that the ratio of a duration $PDA_pSF1$ of a portion of an address period $A_pSF1$ to a total duration $DA_pSF1$ of the address period $A_pSF1$ of the first subfield SF1 of the p-th frame at a reference time point $t_1$ after a predetermined period of time from a start time point $t_0$ of the p-th frame is substantially equal to the ratio of a duration $PDA_qSF1$ of a portion of an address period $A_qSF1$ to a total duration $DA_qSF1$ of the address period $A_qSF1$ of the first subfield SF1 of the q-th frame at a reference time point $t_1$ after a predetermined period of time from a start time point $t_0$ of the q-th frame.

The driving signal controller 140 controls a location of the second subfield SF2 of each of the p-th frame and the q-th frame so that the ratio of a duration $PDA_pSF2$ of a portion of an address period $A_pSF2$ to a total duration $DA_pSF2$ of the address period $A_pSF2$ of the second subfield SF2 of the p-th frame at a reference time point $t_2$ after a predetermined period of time from the start time point $t_0$ of the p-th frame is substantially equal to the ratio of a duration $PDA_qSF2$ of a portion of an address period $A_qSF2$ to a total duration $DA_qSF2$ of the address period $A_qSF2$ of the second subfield SF2 of the q-th frame at a reference time point $t_2$ after a predetermined period of time from the start time point $t_0$ of the q-th frame.

As described above, the driving signal controller 140 controls a location of an r-th subfield of each of the p-th frame and the q-th frame so that a relative time ratio of an address period of the r-th subfield of the p-th frame at a reference time point of the r-th subfield of the p-th frame is substantially equal to a relative time ratio of an address period of the r-th subfield of the q-th frame at a reference time point of the r-th subfield of the q-th frame. Accordingly, as illustrated in FIG. 8*b*, address periods of subfields constituting each frame start at the same time point, for example, $t_1$, $t_2$, $t_3$, . . . such that locations of the subfields of each frame are fixed. As a result, the driving signal controller 140 easily and rapidly calculates the locations of the subfields of each frame, thereby simplifying the configuration of the driving signal controller 140.

As illustrated in FIGS. 7*a* and 7*b*, when the total durations of the address periods of the subfields are equal to one another, it is possible to fix the locations of the subfields. As illustrated in FIGS. 8*a* and 8*b*, when the total durations of the address periods of the subfields are different from one another, it is possible to fix the locations of the subfields.

Figure 9A:
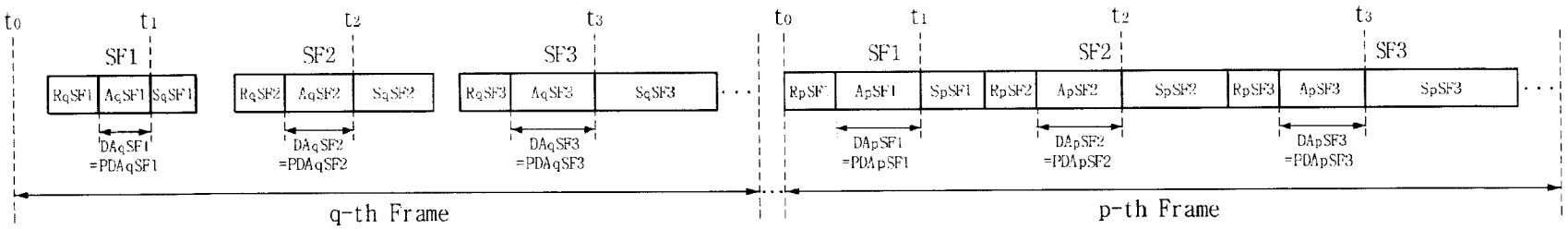
FIGS. 9*a* and 9*b* illustrate another example of an operation of the driving signal controller of the plasma display apparatus.
Figure 9B:
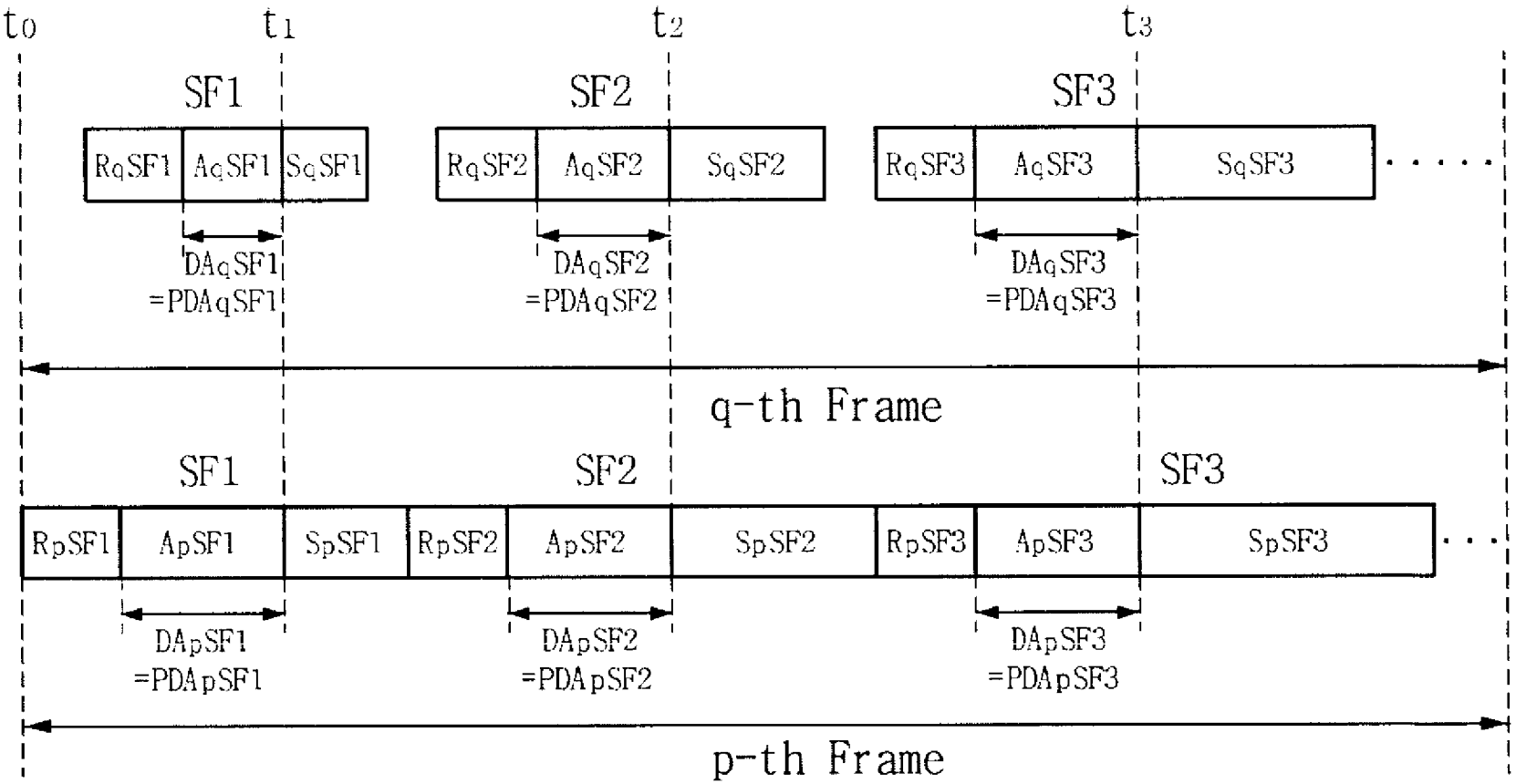

FIGS. 9*a* and 9*b* illustrate another example of an operation of the driving signal controller of the plasma display apparatus. As illustrated in FIGS. 9*a* and 9*b*, an APL of the p-th frame is less than an APL of the q-th frame.

As illustrated in FIG. 9*a*, the driving signal controller 140 controls a location of the first subfield SF1 of each of the p-th frame and the q-th frame so that the ratio (=1) of a duration $PDA_pSF1$ of a portion of an address period $A_pSF1$ to a total duration $DA_pSF1$ of the address period $A_pSF1$ of the first subfield SF1 of the p-th frame at a reference time point $t_1$ after a predetermined period of time from a start time point $t_0$ of the p-th frame is substantially equal to the ratio (=1) of a duration $PDA_qSF1$ of a portion of an address period $A_qSF1$ to a total duration $DA_qSF1$ of the address period $A_qSF1$ of the first subfield SF1 of the q-th frame at a reference time point $t_1$ after a predetermined period of time from a start time point $t_0$ of the q-th frame.

The driving signal controller 140 controls a location of the second subfield SF2 of each of the p-th frame and the q-th frame so that the ratio (=1) of a duration $PDA_pSF2$ of a portion of an address period $A_pSF2$ to a total duration $DA_pSF2$ of the address period $A_pSF2$ of the second subfield SF2 of the p-th frame at a reference time point $t_2$ after a predetermined period of time from the start time point $t_0$ of the p-th frame is substantially equal to the ratio (=1) of a duration $PDA_qSF2$ of a portion of an address period $A_qSF2$ to a total duration $DA_qSF2$ of the address period $A_qSF2$ of the second subfield SF2 of the q-th frame at a reference time point $t_2$ after a predetermined period of time from the start time point $t_0$ of the q-th frame.

As described above, the driving signal controller 140 controls a location of an r-th subfield of each of the p-th frame and the q-th frame so that a relative time ratio of an address period of the r-th subfield of the p-th frame at a reference time point of the r-th subfield of the p-th frame is substantially equal to a relative time ratio of an address period of the r-th subfield of the q-th frame at a reference time point of the r-th subfield of the q-th frame. Accordingly, as illustrated in FIG. 9*b*, address periods of subfields constituting each frame start at the same time point, for example, $t_1$, $t_2$, $t_3$, . . . such that locations of the subfields of each frame are fixed. As a result, the driving signal controller 140 easily and rapidly calculates the locations of the subfields of each frame, thereby simplifying the configuration of the driving signal controller 140.

Figure 10A:
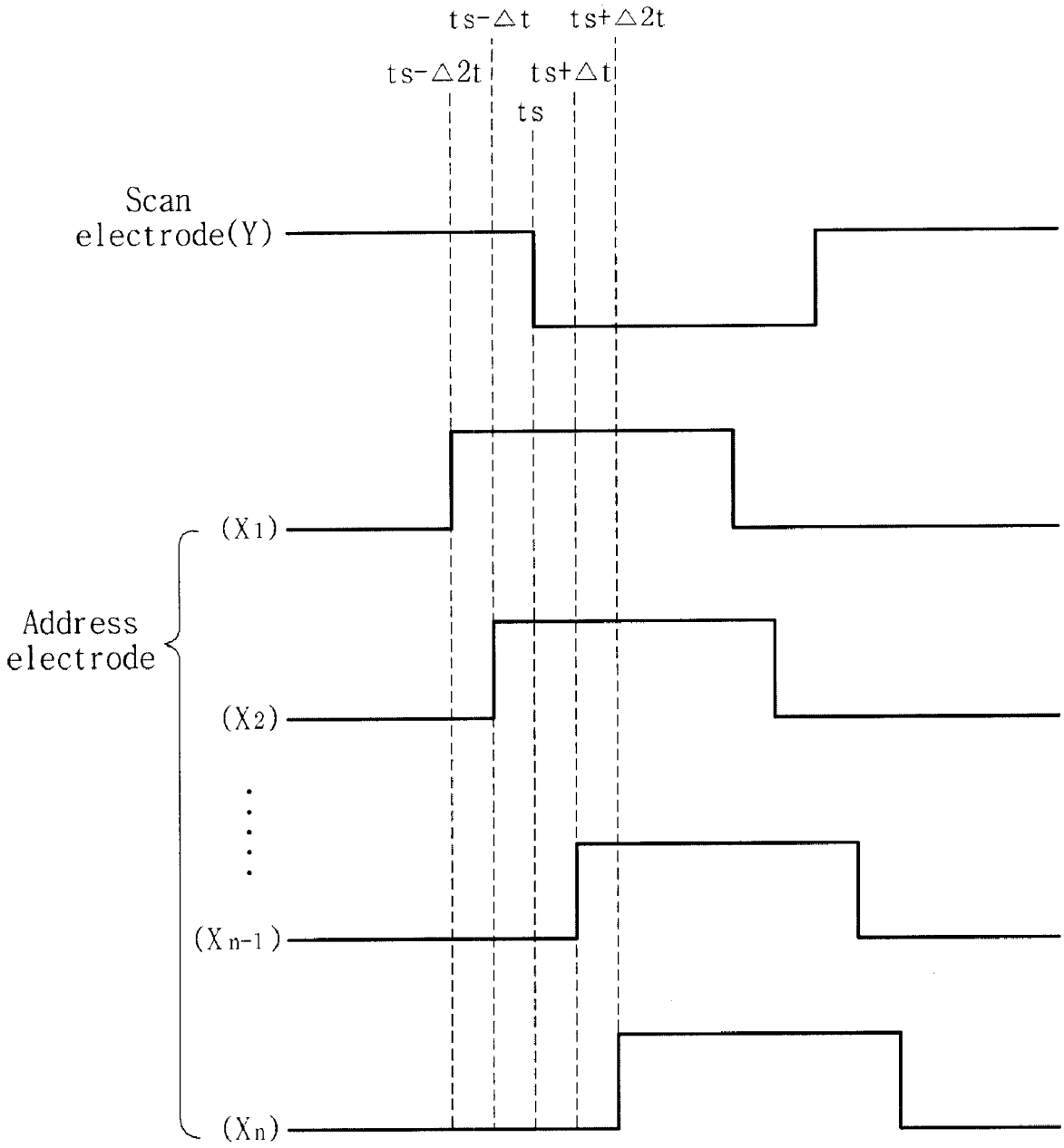
FIGS. 10*a* through 10*c* illustrate a change in a duration of an address period.
Figure 10B:
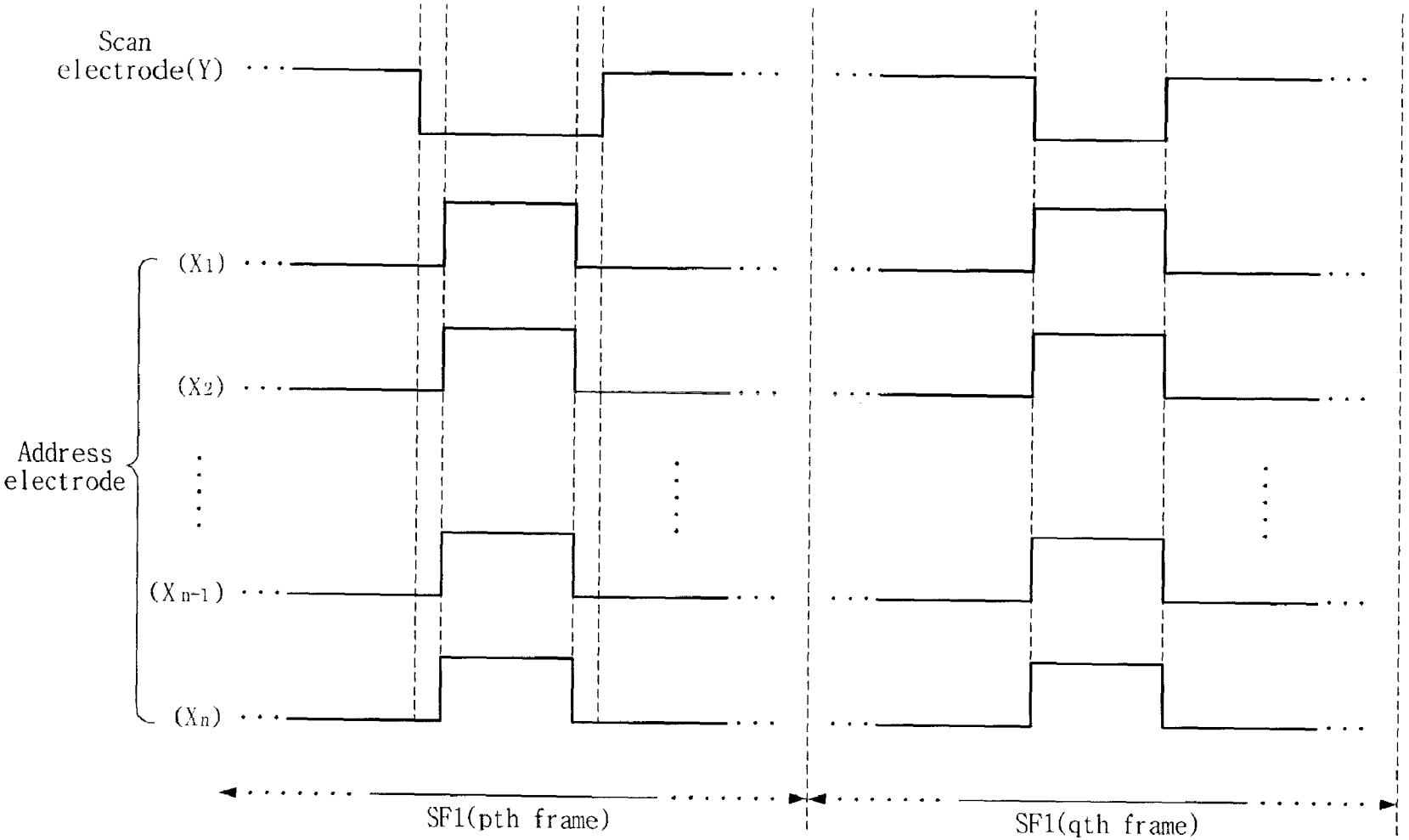
Figure 10C:
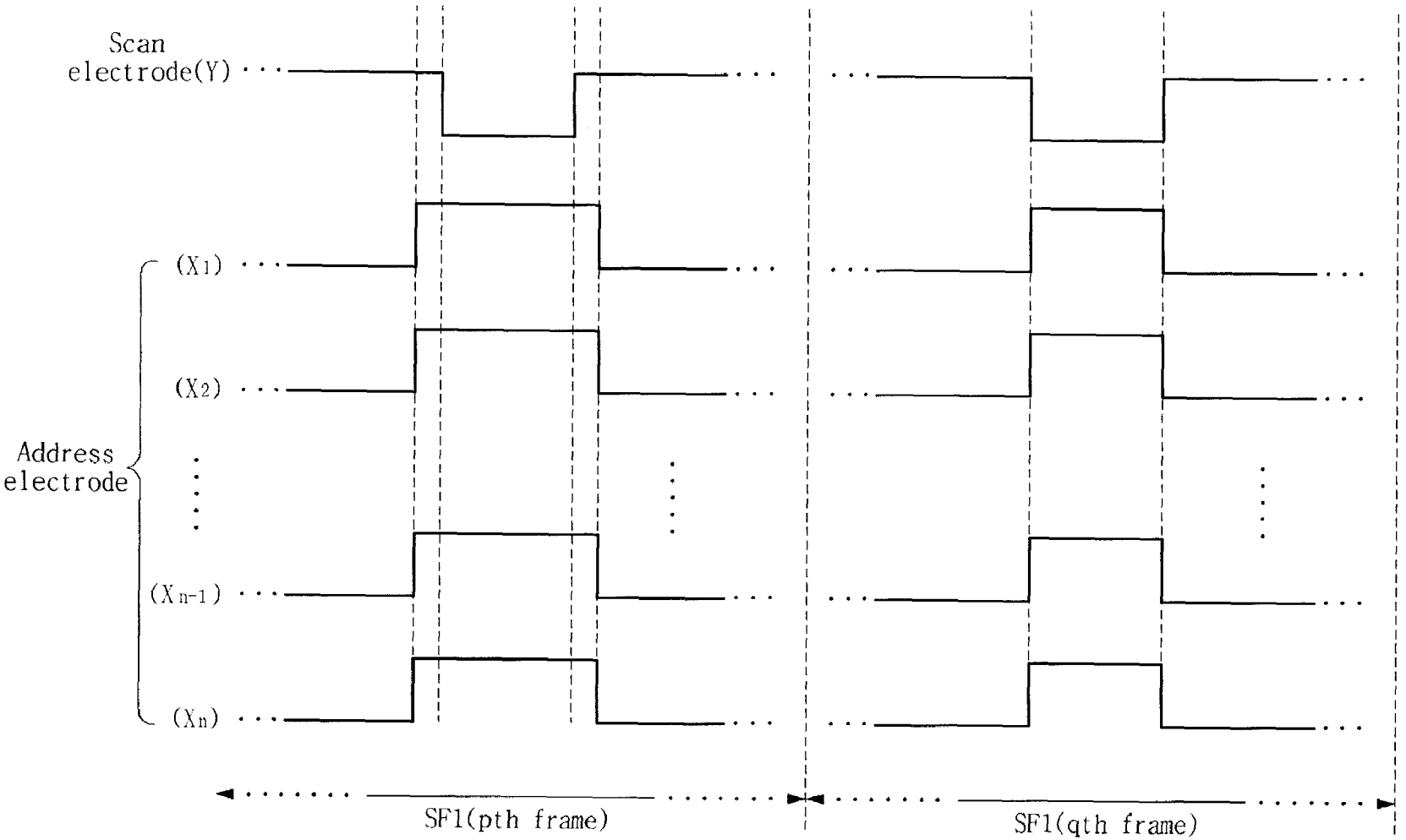

FIGS. 10*a* and 10*c* illustrate a change in a duration of an address period. As illustrate in FIGS. 8*a*, 8*b*, 9*a* and 9*b*, a duration of an address period may vary for the driving of the plasma display apparatus. As illustrate in FIG. 10*a*, the driving signal controller 140 controls the scan driver 110 and the data driver 120 so that a supply time point of a data signal supplied to the address electrodes X1 to Xn during an address period of one subfield is different from a supply time point of a scan signal supplied to the scan electrodes Y during the address period of one subfield.

For example, as illustrate in FIG. 10*a*, when a supply time point of a scan signal supplied to the scan electrodes Y is ts, a data signal is supplied to the address electrode X1 at a time point (ts−Δ2t) earlier than the supply time point ts of a scan signal by an interval of Δ2t. Further, a data signal is supplied to the address electrode X2 at a time point (ts−Δt) earlier than the supply time point ts of a scan signal by an interval of Δt. In the same manner, a data signal is supplied to the address electrode Xn−1 at a time point (ts+Δt), and a data signal is supplied to the address electrode Xn at a time point (ts+Δ2t).

As illustrate in FIG. 10*b*, the driving signal controller 140 may control the width of a scan signal supplied during the address period of the r-th subfield of the p-th frame to be different from the width of a scan signal supplied during the address period of the r-th subfield of the q-th frame. For example, the width of a scan signal supplied during the address period of the first subfield SF1 of the p-th frame may be more than the width of a scan signal supplied during the address period of the first subfield SE1 of the q-th frame.

As illustrate in FIG. 10*c*, the driving signal controller 140 may control the width of a data signal supplied during the address period of the r-th subfield of the p-th frame to be different from the width of a data signal supplied during the address period of the r-th subfield of the q-th frame. For example, the width of a data signal supplied during the address period of the first subfield SF1 of the p-th frame may be more than the width of a data signal supplied during the address period of the first subfield SF1 of the q-th frame.

Figure 11A:
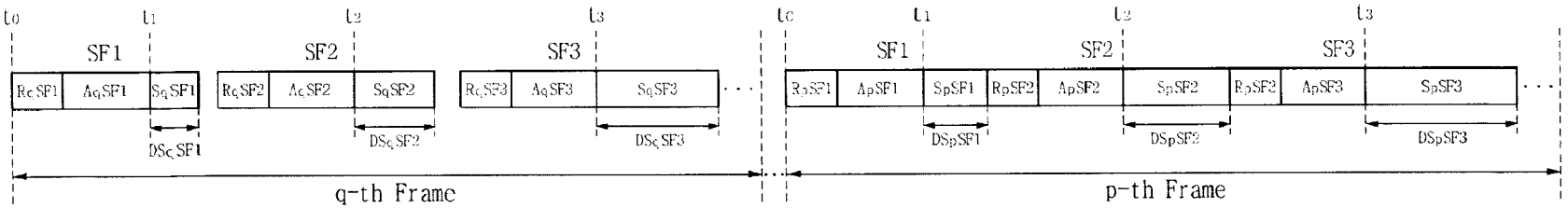
FIGS. 11*a* and 11*b* illustrate another example of an operation of the driving signal controller of the plasma display apparatus.
Figure 11B:
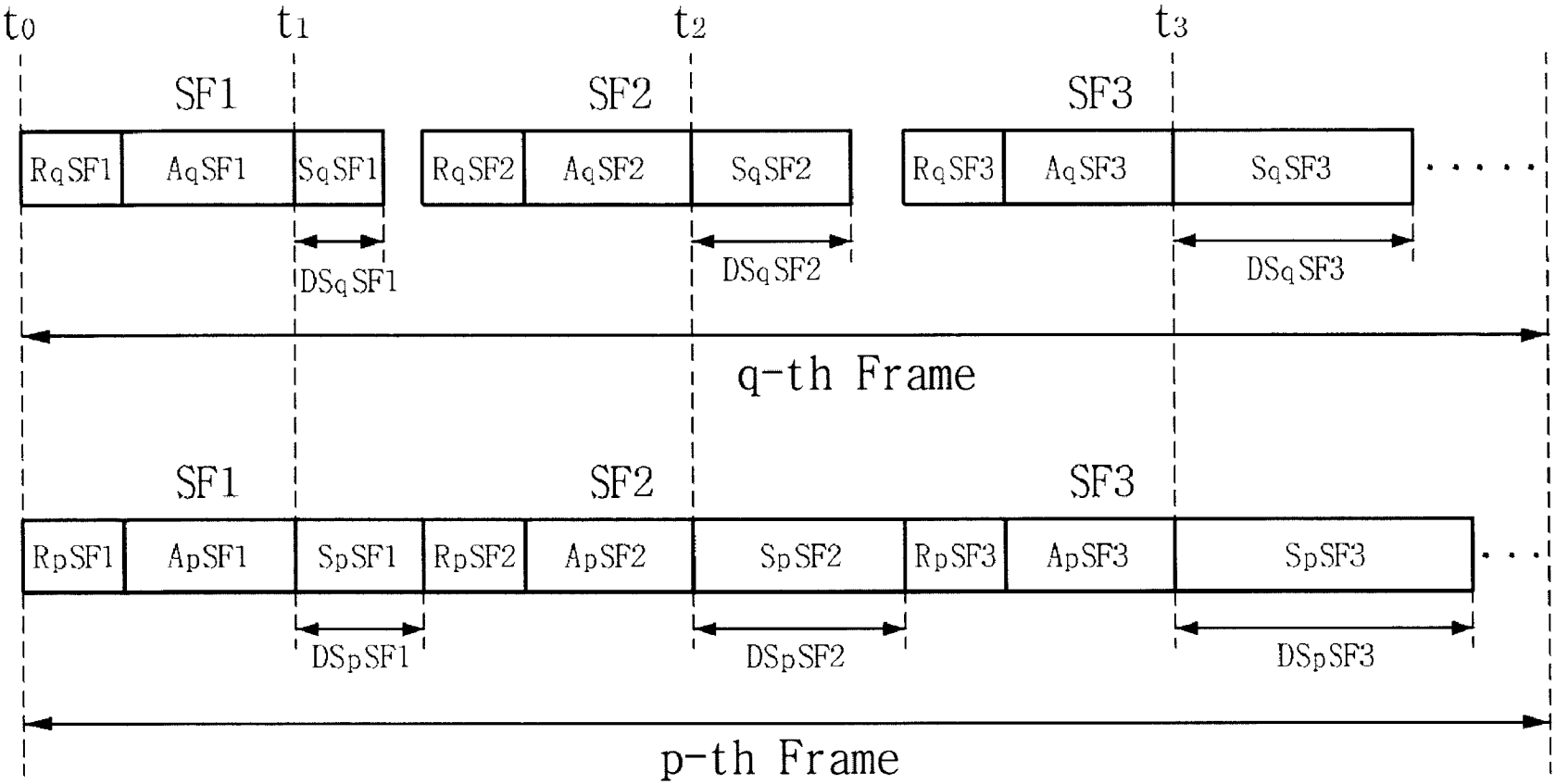

FIGS. 11*a* and 11*b* illustrate another example of an operation of the driving signal controller of the plasma display apparatus. As illustrated in FIGS. 11*a* and 11*b*, an APL of the p-th frame is less than an APL of the q-th frame.

As illustrated in FIG. 11*a*, the driving signal controller 140 controls a location of the first subfield SF1 of each of the p-th frame and the q-th frame so that the ratio of a duration (=0) of a portion of a sustain period $S_p$SF1 to a total duration $DS_p$SF1 of the sustain period $S_p$SF1 of the first subfield SF1 of the p-th frame and the ratio of a duration (=0) of a portion of a sustain period $S_q$SF1 to a total duration $DS_q$SF1 of the sustain period $S_q$SF1 of the first subfield SF1 of the q-th frame are 0 at a reference time point $t_1$ after a predetermined period of time from a start time point $t_0$ of each of the p-th frame and the q-th frame.

The driving signal controller 140 controls a location of the second subfield SF2 of each of the p-th frame and the q-th frame so that the ratio of a duration (=0) of a portion of a sustain period $S_p$SF2 to a total duration $DS_p$SF2 of the sustain period $S_p$SF2 of the second subfield SF2 of the p-th frame and the ratio of a duration (=0) of a portion of a sustain period $S_q$SF2 to a total duration $DS_q$SF2 of the sustain period $S_q$SF2 of the second subfield SF2 of the q-th frame are 0 at a reference time point $t_2$ after a predetermined period of time from the start time point $t_0$ of each of the p-th frame and the q-th frame.

As described above, the driving signal controller 140 controls a location of an r-th subfield of each of the p-th frame and the q-th frame so that a relative time ratio of a sustain period of the r-th subfield of the p-th frame at a reference time point of the r-th subfield of the p-th frame is substantially equal to a relative time ratio of a sustain period of the r-th subfield of the q-th frame at a reference time point of the r-th subfield of the q-th frame. Accordingly, as illustrated in FIG. 11*b*, sustain periods of subfields constituting each frame start at the same time point such that locations of the subfields of each frame are fixed. As a result, the driving signal controller 140 easily and rapidly calculates the locations of the subfields of each frame, thereby simplifying the configuration of the driving signal controller 140.

Figure 12A:
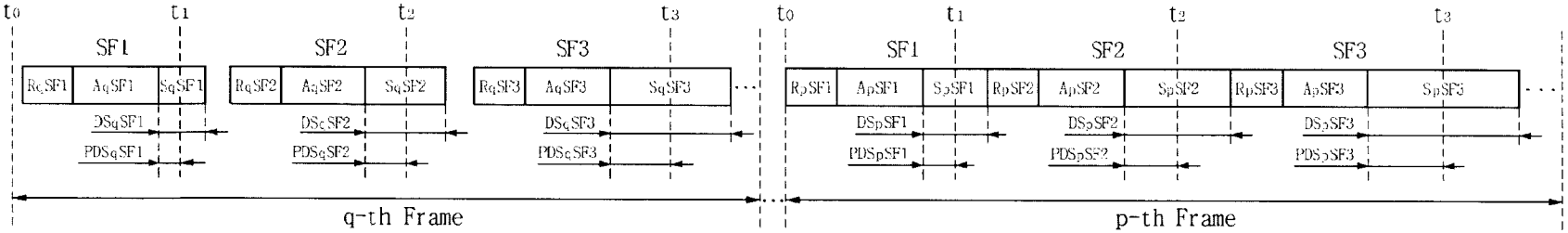
FIGS. 12*a* and 12*b* illustrate another example of an operation of the driving signal controller of the plasma display apparatus.
Figure 12B:
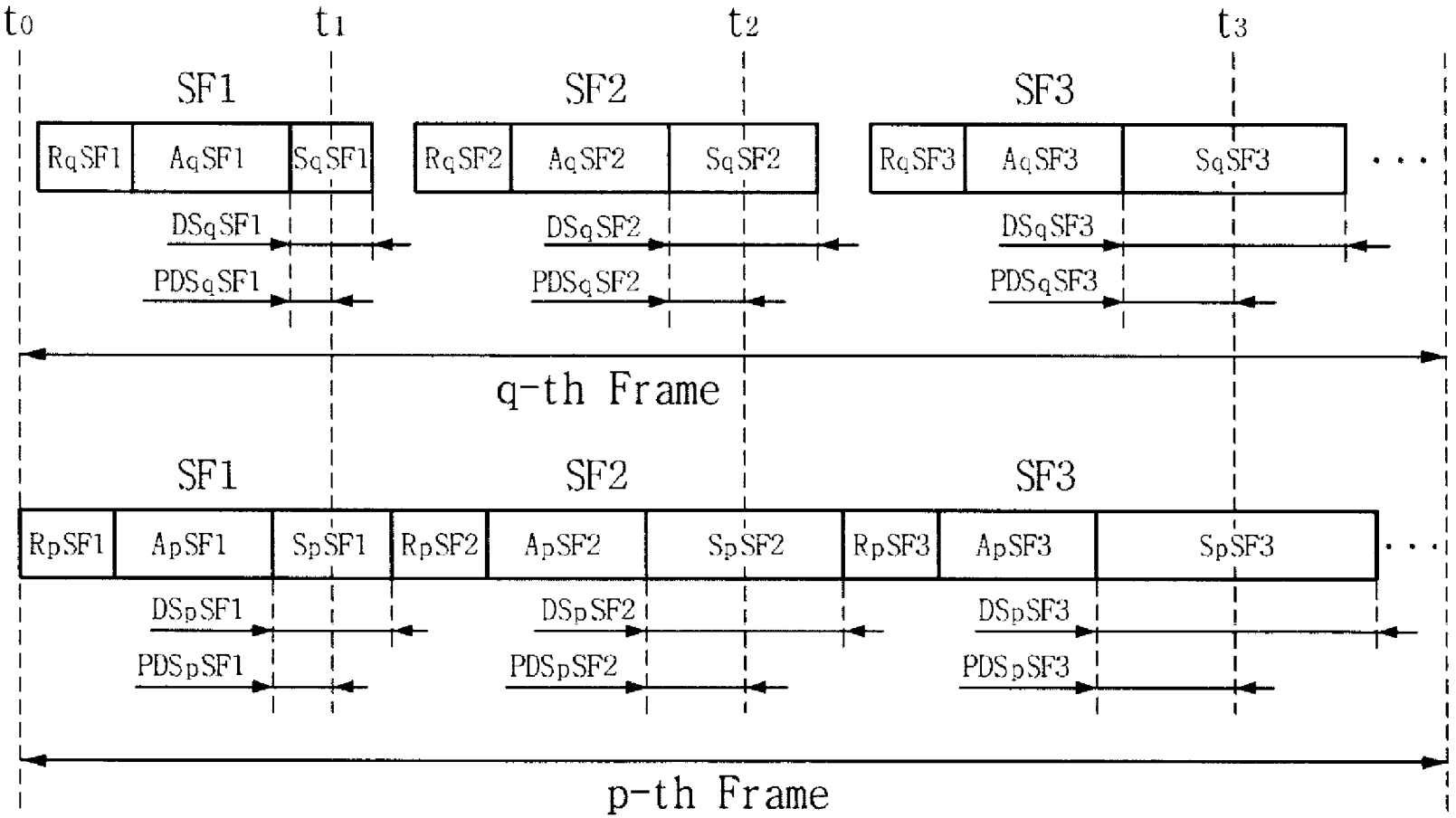

FIGS. 12*a* and 12*b* illustrate another example of an operation of the driving signal controller of the plasma display apparatus. As illustrated in FIGS. 12*a* and 12*b*, an APL of the p-th frame is less than an APL of the q-th frame.

As illustrated in FIG. 12*a*, the driving signal controller 140 controls a location of the first subfield SF1 of each of the p-th frame and the q-th frame so that the ratio of a duration $PDS_p$SF1 of a portion of a sustain period $S_p$SF1 to a total duration $DS_p$SF1 of the sustain period $S_p$SF1 of the first subfield SF1 of the p-th frame at a reference time point $t_1$ after a predetermined period of time from a start time point $t_0$ of the p-th frame is substantially equal to the ratio of a duration $PDS_q$SF1 of a portion of a sustain period $S_q$SF1 to a total duration $DS_q$SF1 of the sustain period $S_q$SF1 of the first subfield SF1 of the q-th frame at a reference time point $t_1$ after a predetermined period of time from a start time point $t_0$ of the q-th frame.

The driving signal controller 140 controls a location of the second subfield SF2 of each of the p-th frame and the q-th frame so that the ratio of a duration $PDS_p$SF2 of a portion of a sustain period $S_p$SF2 to a total duration $DS_p$SF2 of the sustain period $S_p$SF2 of the second subfield SF2 of the p-th frame at a reference time point $t_2$ after a predetermined period of time from the start time point $t_0$ of the p-th frame is substantially equal to the ratio of a duration $PDS_q$SF1 of a portion of a sustain period $S_q$SF2 to a total duration $DS_q$SF2 of the sustain period $S_q$SF2 of the second subfield SF2 of the q-th frame at a reference time point $t_2$ after a predetermined period of time from the start time point $t_0$ of the q-th frame.

As described above, the driving signal controller 140 controls a location of an r-th subfield of each of the p-th frame and the q-th frame so that a relative time ratio of a sustain period of the r-th subfield of the p-th frame at a reference time point of the r-th subfield of the p-th frame is substantially equal to a relative time ratio of a sustain period of the r-th subfield of the q-th frame at a reference time point of the r-th subfield of the q-th frame. Accordingly, as illustrated in FIG. 12*b*, sustain periods of subfields constituting each frame start at the same time point, for example, $t_1$, $t_2$, $t_3$, . . . such that locations of the subfields of each frame are fixed. As a result, the driving signal controller 140 easily and rapidly calculates the locations of the subfields of each frame, thereby simplifying the configuration of the driving signal controller 140.

Figure 13A:
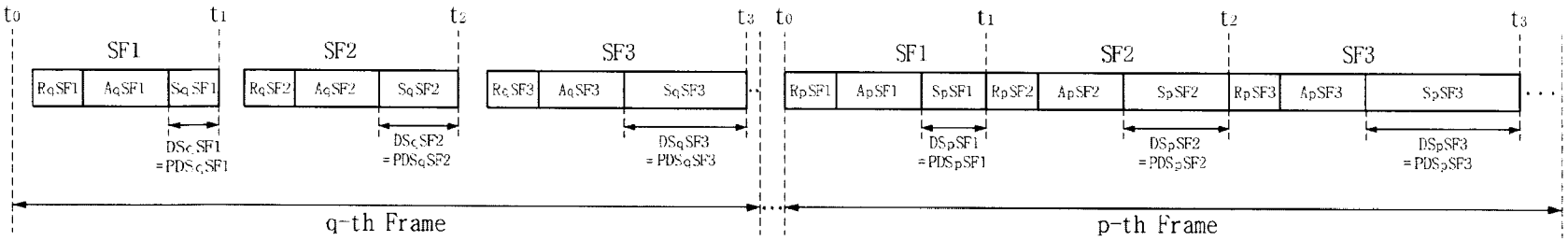
FIGS. 13*a* and 13*b* illustrate another example of an operation of the driving signal controller of the plasma display apparatus.
Figure 13B:
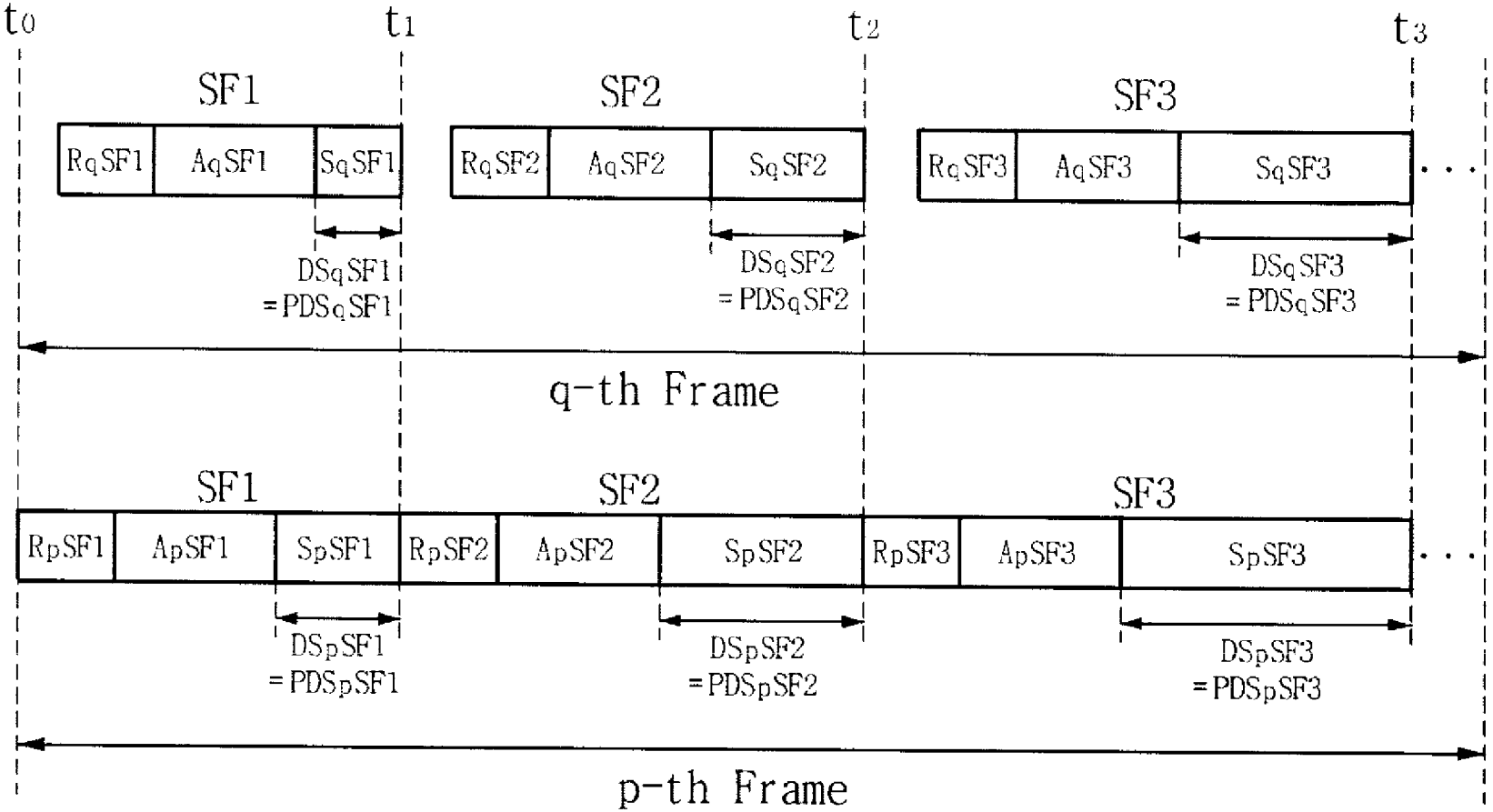

FIGS. 13*a* and 13*b* illustrate another example of an operation of the driving signal controller of the plasma display apparatus. As illustrated in FIGS. 13*a* and 13*b*, an APL of the p-th frame is less than an APL of the q-th frame.

As illustrated in FIG. 13*a*, the driving signal controller 140 controls a location of the first subfield SF1 of each of the p-th frame and the q-th frame so that the ratio (=1) of a duration $PDS_p$SF1 of a portion of a sustain period $S_p$SF1 to a total duration $DS_p$SF1 of the sustain period $S_p$SF1 of the first subfield SF1 of the p-th frame at a reference time point $t_1$ after a predetermined period of time from a start time point $t_0$ of the p-th frame is substantially equal to the ratio (=1) of a duration $PDS_q$SF1 of a portion of a sustain period $S_q$SF1 to a total duration $DS_q$SF1 of the sustain period $S_q$SF1 of the first subfield SF1 of the q-th frame at a reference time point $t_1$ after a predetermined period of time from a start time point $t_0$ of the q-th frame.

The driving signal controller 140 controls a location of the second subfield SF2 of each of the p-th frame and the q-th frame so that the ratio (=1) of a duration $PDS_p$SF2 of a portion of a sustain period $S_p$SF2 to a total duration $DS_p$SF2 of the sustain period $S_p$SF2 of the second subfield SF2 of the p-th frame at a reference time point $t_2$ after a predetermined period of time from the start time point $t_0$ of the p-th frame is substantially equal to the ratio (=1) of a duration $PDS_q$SF2 of a portion of a sustain period $S_q$SF2 to a total duration $DS_q$SF2 of the sustain period $S_q$SF2 of the second subfield SF2 of the q-th frame at a reference time point $t_2$ after a predetermined period of time from the start time point $t_0$ of the q-th frame.

As described above, the driving signal controller 140 controls a location of an r-th subfield of each of the p-th frame and the q-th frame so that a relative time ratio of a sustain period of the r-th subfield of the p-th frame at a reference time point of the r-th subfield of the p-th frame is substantially equal to a relative time ratio of a sustain period of the r-th subfield of the q-th frame at a reference time point of the r-th subfield of the q-th frame. Accordingly, as illustrated in FIG. 13*b*, sustain periods of subfields constituting each frame start at the same time point, for example, $t_1, t_2, t_3, \ldots$ such that locations of the subfields of each frame are fixed. As a result, the driving signal controller 140 easily and rapidly calculates the locations of the subfields of each frame, thereby simplifying the configuration of the driving signal controller 140.

The driving signal controller 140 calculates a light-emission center by the following Equation 1 to control the locations of the subfields of each of the p-th frame and the q-th frame.

$$\text{Light-emission center} = \frac{\sum_{i=1}^{N} \text{SUS_DISi}}{N} \quad \text{[Equation 1]}$$

In the above Equation 1, N indicates a total number of sustain signals supplied during a sustain period of one subfield. SUS_DISi indicates a duration of time ranging from a start time point of the sustain period of one subfield to a supply time point of an i-th sustain signal during the sustain period. In other words, SUS_DISi indicates a duration of time ranging from a start time point of a sustain period of one subfield to a light-emission time point of an i-th sustain signal during the sustain period. A light-emission time point of a sustain signal may mean a time point when a sustain signal reaches the highest voltage, or a time point when intensity of light generated by a sustain signal is at the maximum, or a time point when a sustain signal is supplied. The light emission center is an average value obtained by dividing a sum of durations of time ranging from a start time point of a sustain period to a light-emission time point of each sustain signal during the sustain period by a total number of sustain signals. The above equation 1 may be easily used in a case where a cycle of the sustain signal supplied during the sustain period is not uniform.

In other words, the driving signal controller 140 controls a reference time point being a light emission center in the sustain period of the r-th subfield of the p-th frame to be substantially equal to a reference time point being a light emission center in the sustain period of the r-th subfield of the q-th frame, thereby controlling the locations of the subfields of each frame. The reference time point being the light emission center in the sustain period of the r-th subfield of the p-th frame is a time point after a first duration of time from a start time point of the p-th frame. The reference time point being the light emission center in the sustain period of the r-th subfield of the q-th frame is a time point after a second duration of time from a start time point of the q-th frame. The first duration of time may be different from the second duration of time.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A method comprising:

controlling a supply of a p-th frame of a first driving signal to begin at a first start time point, and a supply of a q-th frame of a second driving signal to begin at a second time point, wherein a duration of one or more periods of an r-th subfield of the q-th frame is different than a duration of the corresponding periods of an r-th subfield of the p-th frame, wherein the supply of the first and second driving signals are controlled such that, at a first set of reference time points occurring a respective set of reference lengths of time after the first start time point:

a ratio of a duration of a reset, address, or sustain period of each of the subfields of the p-th frame of the first driving signal that has been supplied up to the corresponding time point in the first set of reference time points, to a total duration of the reset, address, or sustain period, is equal to a ratio of a duration of the corresponding reset, address, or sustain period of each of the subfields of the q-th frame of the second driving signal that has been supplied up to a corresponding time point in a second set of reference time points, to a total duration of the corresponding reset, address, or sustain period, the second set of reference time points occurring the set reference lengths of time after the second start time point, and wherein the set reference lengths of time are respectively equal to lengths of time between the first time point and a light emission center of the reset, address, or sustain period of each of the subfields of the p-th frame.

2. The method of claim 1, wherein an APL during the p-th frame is different than an APL during the q-th frame.

3. The method of claim 1, wherein a highest voltage of a reset signal supplied during the reset period of the r-th subfield of the p-th frame is different from a highest voltage of a reset signal supplied during the reset period of the r-th subfield of the q-th frame.

4. The method of claim 1, wherein a total width of a scan signal supplied during the address period of the r-th subfield of the p-th frame is different from a total width of a scan signal supplied during the address period of the r-th subfield of the q-th frame.

5. The method of claim 1, wherein the light emission center is obtained by:

$$\text{Light emission center} = \frac{\sum_{i=1}^{N} \text{SUS_DISi}}{N}$$

wherein N indicates a total number of sustain signals supplied during a sustain period of one subfield and SUS_DISi indicates a duration of time ranging from a start time point of the sustain period of one subfield to a supply time point of an i-th sustain signal during the sustain period.

6. The method of claim 1, wherein:

the supply of the first and second driving signals are controlled such that:

at the first set of reference time points occurring the respective set of reference lengths of time after the first start time point, the ratio of the duration of the address period of each of the subfields of the p-th frame of the first driving signal that has been supplied up to the corresponding time point in the first set of reference time points, to the total duration of the address period, is equal to the ratio of the duration of the corresponding address period of each of the subfields of the q-th frame of the second driving signal that has been supplied up to the corresponding time point in a second set of reference time points, to the total duration of the corresponding address period, the second set of reference time points occurring the set reference lengths of time after the second start time point.

7. The method of claim 1, wherein:

the supply of the first and second driving signals are controlled such that:

at the first set of reference time points occurring the respective set of reference lengths of time after the first start time point, the ratio of the duration of the sustain period of each of the subfields of the p-th frame of the first driving signal that has been supplied up to the corresponding time point in the first set of reference time points, to the total duration of the sustain period, is equal to the ratio of the duration of the corresponding sustain period of each of the subfields of the q-th frame of the second driving signal that has been supplied up to the corresponding time point in a second set of reference time points, to the total duration of the corresponding sustain period, the second set of reference time points occurring the set reference lengths of time after the second start time point.

8. The method of claim 1, wherein:

the supply of the first and second driving signals are controlled such that:

at the first set of reference time points occurring the respective set of reference lengths of time after the first start time point, the ratio of the duration of the reset period of each of the subfields of the p-th frame of the first driving signal that has been supplied up to the corresponding time point in the first set of reference time points, to the total duration of the reset period, is equal to the ratio of the duration of the corresponding reset period of each of the subfields of the q-th frame of the second driving signal that has been supplied up to the corresponding time point in a second set of reference time points, to the total duration of the corresponding reset period, the second set of reference time points occurring the set reference lengths of time after the second start time point.

9. A system comprising:

a plasma display panel comprising an electrode;

an electrode driver for supplying a driving signal to the electrode; and a driving signal controller, wherein the driving signal controller is configured to:

control a supply of a p-th frame of a first driving signal to begin at a first start time point, and a supply of a q-th frame of a second driving signal to begin at a second time point, wherein a duration of one or more periods of an r-th subfield of the q-th frame is different than a duration of the corresponding periods of an r-th subfield of the p-th frame, wherein the supply of the first and second driving signals are controlled such that, at a first set of reference time points occurring a respective set of reference lengths of time after the first start time point:

a ratio of a duration of a reset, address, or sustain period of each of the subfields of the p-th frame of the first driving signal that has been supplied up to the corresponding time point in the first set of reference time points, to a total duration of the reset, address, or sustain period, is equal to a ratio of a duration of the corresponding reset, address, or sustain period of each of the subfields of the q-th frame of the second driving signal that has been supplied up to a corresponding time point in a second set of reference time points, to a total duration of the corresponding reset, address, or sustain period, the second set of reference time points occurring the set reference lengths of time after the second start time point, and wherein the set reference lengths of time are respectively equal to lengths of time between the first time point and a light emission center of the reset, address, or sustain period of each of the subfields of the p-th frame.

10. The system of claim 9, wherein a highest voltage of a reset signal supplied during the reset period of the r-th subfield of the p-th frame is different from a highest voltage of a reset signal supplied during the reset period of the r-th subfield of the q-th frame.

11. The system of claim 9, wherein a total width of a scan signal supplied during the address period of the r-th subfield of the p-th frame is different from a total width of a scan signal supplied during the address period of the r-th subfield of the q-th frame.

12. The system of claim 9, wherein the light emission center is obtained by:

$$\text{Light emission center} = \frac{\sum_{i=1}^{N} \text{SUS_DISi}}{N}$$

wherein N indicates a total number of sustain signals supplied during a sustain period of one subfield, and SUS_DISi indicates a duration of time ranging from a start time point of the sustain period of one subfield to a supply time point of an i-th sustain signal during the sustain period.

13. A computer readable medium encoded with a computer program product comprising instructions that, when executed, operate to cause a computer to perform operations comprising:

controlling a supply of a p-th frame of a first driving signal to begin at a first start time point, and a supply of a q-th frame of a second driving signal to begin at a second time point, wherein a duration of one or more periods of an r-th subfield of the q-th frame is different than a duration of the corresponding periods of an r-th subfield of the p-th frame, wherein the supply of the first and second driving signals are controlled such that, at a first set of reference time points occurring a respective set of reference lengths of time after the first start time point:

a ratio of a duration of a reset, address, or sustain period of each of the subfields of the p-th frame of the first driving signal that has been supplied up to the corresponding time point in the first set of reference time points, to a total duration of the reset, address, or sustain period, is equal to a ratio of a duration of the corresponding reset, address, or sustain period of each of the subfields of the q-th frame of the second driving signal that has been supplied up to a corresponding time point in a second set of reference time points, to a total duration of the corresponding reset, address, or sustain period, the second set of reference time points occurring the set reference lengths of time after the second start time point, and wherein the set reference lengths of time are respectively equal to lengths of time between the first time point and a light emission center of the reset, address, or sustain period of each of the subfields of the p-th frame.

14. The computer readable medium of claim 13, wherein a highest voltage of a reset signal supplied during the reset period of the r-th subfield of the p-th frame is different from a highest voltage of a reset signal supplied during the reset period of the r-th subfield of the q-th frame.

15. The computer readable medium of claim 13, wherein a total width of a scan signal supplied during the address period of the r-th subfield of the p-th frame is different from a total width of a scan signal supplied during the address period of the r-th subfield of the q-th frame.

16. The computer readable medium of claim 13, wherein the light emission center is obtained by:

$$\text{light emission center} = \frac{\sum_{i=1}^{N} \text{SUS_DISi}}{N}$$

wherein N indicates a total number of sustain signals supplied during a sustain period of one subfield and SUS_DISi indicates a duration of time ranging from a start time point of the sustain period of one subfield to a supply time point of an i-th sustain signal during the sustain period.

* * * * *